US008106585B2

(12) United States Patent
Sakaguchi et al.

(10) Patent No.: US 8,106,585 B2
(45) Date of Patent: Jan. 31, 2012

(54) MANUFACTURING METHOD OF HIGH-PRESSURE DISCHARGE LAMP, HIGH-PRESSURE DISCHARGE LAMP, LAMP UNIT USING HIGH-PRESSURE DISCHARGE LAMP, AND IMAGE DISPLAY APPARATUS USING HIGH-PRESSURE DISCHARGE LAMP

(75) Inventors: Jun Sakaguchi, Takatsuki (JP); Syunsuke Ono, Takatsuki (JP); Yoshitaka Kurimoto, Takatsuki (JP); Toshiyuki Shimizu, Takatsuki (JP); Shinichiro Hataoka, Katano (JP); Kiyoshi Takahashi, Kyotanabe (JP); Takashi Tsutatani, Ohtsu (JP); Tomoyuki Seki, Takatsuki (JP); Makoto Horiuchi, Sakurai (JP); Tsuyoshi Ichibakase, Takatsuki (JP)

(73) Assignee: Panasonic Corporation, Osaka (JP)

( * ) Notice: Subject to any disclaimer, the term of this patent is extended or adjusted under 35 U.S.C. 154(b) by 1157 days.

(21) Appl. No.: 10/548,974

(22) PCT Filed: Mar. 17, 2004

(86) PCT No.: PCT/JP2004/003568

§ 371 (c)(1), (2), (4) Date: Sep. 26, 2006

(87) PCT Pub. No.: WO2004/084253

PCT Pub. Date: Sep. 30, 2004

(65) Prior Publication Data

US 2007/0052365 A1 Mar. 8, 2007

(30) Foreign Application Priority Data

Mar. 17, 2003 (JP) ..... 2003-071422
Mar. 27, 2003 (JP) ..... 2003-088414
Mar. 28, 2003 (JP) ..... 2003-091201

(51) Int. Cl.
*H01J 61/36* (2006.01)

(52) U.S. Cl. ..... 313/578; 313/636; 313/493

(58) Field of Classification Search ..... 313/568, 313/636, 573, 578, 493
See application file for complete search history.

(56) References Cited

U.S. PATENT DOCUMENTS 3,189,395 A * 6/1965 Demas ..... 445/10
5,096,479 A 3/1992 Allen et al.
5,109,181 A 4/1992 Fischer et al.
(Continued)

FOREIGN PATENT DOCUMENTS

CN 1218273 A 6/1999
(Continued)

OTHER PUBLICATIONS

XP-002432802: Database WPI Week 198736, Derwent Publication Ltd., London, GB; AN 1987-255869, SU 1 285 543 A (Light Source Eng): Jan. 23, 1987.

*Primary Examiner* — Toan Ton
*Assistant Examiner* — Fatima Farokhrooz

(57) ABSTRACT

A manufacturing method of a high-pressure mercury lamp includes an electric field application step in which an electric field is applied to at least a light emission part (4) with the high-pressure mercury lamp being kept at a high temperature. This can reduce impurities such as hydrogen and alkali metals in a discharge space (8) and glass forming the light emission part (4). As a consequence, blackening and devitrification of the high-pressure mercury lamp while the lamp is lit can be reduced.

5 Claims, 18 Drawing Sheets

U.S. PATENT DOCUMENTS

| | | | | |
|---|---|---|---|---|
| 5,532,195 | A * | 7/1996 | Weiss et al. | 501/54 |
| 5,680,010 | A * | 10/1997 | Weiss et al. | 313/636 |
| 6,232,719 | B1 * | 5/2001 | Kaneko et al. | 313/625 |
| 6,483,240 | B2 | 11/2002 | O'Hare et al. | |
| 6,573,656 | B2 | 6/2003 | Kaneko et al. | |
| 2001/0050535 | A1 | 12/2001 | Tagawa | |
| 2002/0031975 | A1 * | 3/2002 | Kanzaki et al. | 445/43 |
| 2002/0047610 | A1 | 4/2002 | Arimoto | |
| 2002/0163315 | A1 * | 11/2002 | Kaneko et al. | 315/246 |
| 2002/0180358 | A1 | 12/2002 | Kobayakawa et al. | |
| 2003/0042856 | A1 * | 3/2003 | Kaneko et al. | 313/639 |

FOREIGN PATENT DOCUMENTS

| | | | | |
|---|---|---|---|---|
| EP | 0 732 870 | A1 | | 9/1996 |
| EP | 0 903 771 | | | 3/1999 |
| EP | 0 903 771 | A2 | | 3/1999 |
| EP | 1 158 558 | A1 | | 11/2001 |
| EP | 1 225 614 | A1 | | 7/2002 |
| EP | 1 619 711 | A1 | | 10/2006 |
| JP | 40-8397 | | | 4/1965 |
| JP | 354094776 | A | * | 7/1979 |
| JP | 02-148561 | | | 7/1990 |
| JP | 406251745 | A | * | 9/1994 |
| JP | 6-310100 | | | 11/1994 |
| JP | 10-134773 | | | 5/1998 |
| JP | 2001-338579 | | | 7/2001 |
| JP | 2001229876 | | * | 8/2001 |
| JP | 2001-266797 | | | 9/2001 |
| JP | 2001266797 | | * | 9/2001 |
| JP | 2002-093361 | | | 3/2002 |
| JP | 3319742 | | | 6/2002 |
| JP | 3385014 | | | 12/2002 |
| SU | 1285543 | A1 | | 1/1987 |

* cited by examiner

FIG.10

TABLE 1

| | AFTER EMITTING LIGHT FOR 300 HOURS | | | AFTER EMITTING LIGHT FOR 2,000 HOURS | | |
|---|---|---|---|---|---|---|
| | BLACKENING | DEVITRIFICATION | ILLUMINANCE MAINTENANCE FACTOR (%) | BLACKENING | DEVITRIFICATION | ILLUMINANCE MAINTENANCE FACTOR (%) |
| PRESENT INVENTED PRODUCT | NO | NO | 98 | NO | NO | 74 |
| COMPARED PRODUCT | YES | YES | 85 | — | — | — |

FIG.11

TABLE 2

| | | ILLUMINANCE MAINTENANCE FACTOR (%) | | OBSERVATION |
|---|---|---|---|---|
| | | AFTER EMITTING LIGHT FOR 1,000 HOURS | AFTER EMITTING LIGHT FOR 2,000 HOURS | |
| APPLIED VOLTAGE | 0V | 70 | — | UNFAVORABLE |
| | −25V | 71 | — | UNFAVORABLE |
| | −50V | 82 | 60 | FAVORABLE |
| | −100V | 89 | 75 | FAVORABLE |
| | −200V | 92 | 78 | FAVORABLE |

TABLE 3

| EXAMINED LAMP | CONVENTIONAL PRODUCT (NO ELECTRIC FIELD IS APPLIED) | | PRESENT INVENTED PRODUCT (ELECTRIC FIELD IS APPLIED) | |
|---|---|---|---|---|
| EXAMINED PART | LIGHT EMISSION PART | SEALED PART | LIGHT EMISSION PART | SEALED PART |
| AMOUNT OF Na(ppm) | 0.61 | 0.44 | 0.11 | 0.70 |

FIG.16

TABLE 4

| | ILLUMINANCE MAINTENANCE FACTOR (%) | |
|---|---|---|
| | AFTER EMITTING LIGHT FOR 1,000 HOURS | AFTER EMITTING LIGHT FOR 2,000 HOURS |
| PRESENT INVENTED PRODUCT | 89 | 74 |
| COMPARED PRODUCT | 76 | — |

FIG.17

TABLE 5

| | | ILLUMINANCE MAINTENANCE FACTOR (%) | | OBSERVATION |
|---|---|---|---|---|
| | | AFTER EMITTING LIGHT FOR 1,000 HOURS | AFTER EMITTING LIGHT FOR 2,000 HOURS | |
| APPLIED VOLTAGE | 0V | 76 | — | UNFAVORABLE |
| | −25V | 75 | — | UNFAVORABLE |
| | −50V | 83 | 60 | FAVORABLE |
| | −100V | 89 | 74 | FAVORABLE |
| | −200V | 89 | 74 | FAVORABLE |

MANUFACTURING METHOD OF HIGH-PRESSURE DISCHARGE LAMP, HIGH-PRESSURE DISCHARGE LAMP, LAMP UNIT USING HIGH-PRESSURE DISCHARGE LAMP, AND IMAGE DISPLAY APPARATUS USING HIGH-PRESSURE DISCHARGE LAMP

TECHNICAL FIELD

The present invention relates to a manufacturing method of a high-pressure discharge lamp, a high-pressure discharge lamp, a lamp unit using the high-pressure discharge lamp, and an image display apparatus using the high-pressure discharge lamp.

BACKGROUND ART

In recent years, image display apparatuses, such as liquid crystal projectors and digital light processing (DLP) projectors, are increasingly used for systems to project broadcast and played-back images or to make presentations with the use of personal computers.

Such image display apparatuses use, as a light source, a short-arc high-pressure mercury lamp (for example, Japanese patent application publication No. H02-148561) which is substantially a point light source.

This high-pressure mercury lamp includes a light emission part having a pair of electrodes therein, and sealed parts which extend from different ends of the light emission part. In each of the sealed parts, a metal foil connected to a corresponding one of the electrodes is sealed airtight (sealed foil structure). In the light emission part, a predetermined amount of mercury, which is a light emitting substance, and a predetermined amount of a halogen to cause a halogen cycle are at least enclosed.

To improve the lifetime and illuminance of the high-pressure mercury lamp, it has recently been attempted to enclose the mercury and halogen at a higher pressure.

However, this attempt poses the following problem.

In the high-pressure mercury lamp, there is a slight gap between a portion of each electrode rod which is placed in a corresponding one of the sealed parts and quartz glass forming the sealed part. Here, a degree of airtightness of the sealed part is dependent on a degree of adhesiveness between the metal foil and the quartz glass forming the sealed part. If the pressure in the light emission part is high, the metal foil and the quartz glass increasingly separate from each other as time elapses after the high-pressure mercury lamp is lit. This causes the enclosed contents in the light emission part to leak out.

To prevent such leakage, Japanese patent application publication No. 2002-93361, for example, suggests the use of VyCor glass (product of Corning, Inc., Japanese registered trademark No. 1657152) including silica ($SiO_2$) principally, and additionally contains aluminum oxide ($Al_2O_3$), boron oxide ($B_2O_3$), sodium oxide ($Na_2O$), and the like. In detail, VyCor glass is provided between quartz glass forming each sealed part and a portion of an electrode rod forming an electrode, which is placed in the sealed part. The electrode rod is tightly adhered to the VyCor glass by the sealing process. This prevents a metal foil and the quartz glass from separating from each other, thereby avoiding leakage of enclosed contents in a light emission part.

However, this high-pressure mercury lamp using VyCor glass to allow high-pressure enclosing has the following drawback. When the high-pressure mercury lamp is lit in such a state that a lengthwise axis of a translucent vessel including the light emission part and the sealed parts extending from different ends of the light emission part is substantially orthogonal to the vertical direction, significant devitrification occurs in quartz glass forming an upper portion of an internal surface of the light emission part. As a result, the luminous flux is reduced, and the high-pressure mercury lamp is swollen due to the devitrification, to be deformed or broken. In addition, the internal surface of the light emission part significantly blackens at an early stage of the lighting.

Such a high-pressure mercury lamp conventionally uses methylene bromide ($CH_2Br_2$) for a halogen. Alternatively, Japanese patent application publication No. 2001-338579, for example, suggests the use of mercury bromide ($HgBr_2$) in order to prevent interfusion of impurities such as carbon and hydrogen into the light emission part.

However, it has been confirmed that a high-pressure mercury lamp in which mercury and mercury bromide as a halogen are enclosed also has the above problems. Specifically speaking, quartz glass forming an upper portion of an internal surface of a light emission part significantly devitrifies. As a result, the luminous flux is reduced, and the high-pressure mercury lamp is swollen due to the devitrification, to be deformed and broken. In addition, the internal surface of the light emission part significantly blackens at an early stage of lighting.

Japanese patent application publication No. 2001-266797 discloses a construction that a conductive heater is wound around each sealed part in a high-pressure mercury lamp of a direct-current (DC) powered type. The conductive heaters are supplied with power before the high-pressure mercury lamp is lit, so as to heat the sealed parts. This has a purpose of shortening a time period required for the lamp to start emitting light after power supply starts and preventing glow discharge which occurs at the start of lamp operation. The disclosure includes an embodiment in which an external lead wire provided in a sealed part on a cathode side is electrically connected to a conductive heater provided for the sealed part at the cathode side. The conductive heater, which is wound around an external surface of the sealed part at the cathode side, has a lower potential than an electrode rod which is placed in the sealed part at the cathode side, because of a voltage drop due to electric currents flowing in the electrode rod and metal foil which are placed in the sealed part at the cathode side. Therefore, an electric field is created between the electrode rod and the conductive heater. As a result, alkaline components in the sealed part are extracted toward the external surface of the sealed part at the cathode side, around which the conductive heater is wound.

It is generally understood that, when the alkaline components exist at an interface between the metal foil made of molybdenum and quartz glass forming the sealed part, connection between the molybdenum and the quartz glass is cut. This lowers connection strength between the metal foil and the quartz glass, thereby lowering the lamp's pressure resistance. According to the above-described construction, the alkaline components are extracted toward the external surface of the sealed part at the cathode side, which prevents a drop in the lamp's pressure resistance.

However, when the above-described construction is applied to a high-pressure mercury lamp with a high output, especially, a rated power of 200 W or more, the following problem emerges. When the high-pressure mercury lamp is lit in such a state that a lengthwise axis of a translucent vessel is substantially orthogonal to the vertical direction, quartz glass forming an upper portion of an internal surface of a light emission part significantly devitrifies. Therefore, the luminous flux is reduced, and the lamp is swollen due to the devitrification, to be deformed or broken. As a result, the high-pressure mercury lamp can not achieve a rated lifetime (2,000 hours). Even when the above-described construction is applied to a high-pressure mercury lamp with a rated power of less than 200 W, the same problem emerges. When the high-pressure mercury lamp is lit for more than 2,000 hours, devitrification becomes noticeable. Therefore, this high-pressure mercury lamp can not attain a long rated lifetime of 10,000 hours or more, and therefore can not meet the demand in the related market.

In particular, irrespective of output power, the above-described problems are found in a high-pressure mercury lamp in which VyCor glass is provided, so as to be tightly adhered to the electrode rods of the electrodes, between quartz glass forming sealed parts and portions of the electrode rods which are placed in the sealed parts, and a high-pressure mercury lamp using electrodes which contain alkali metals of 12 ppm or more as impurities. Specifically speaking, when these lamps are lit in such a state that a lengthwise axis of a translucent vessel is substantially orthogonal to the vertical direction, an upper portion of an internal surface of the translucent vessel significantly devitrifies. In addition, the internal surface of the translucent vessel blackens.

The above-mentioned problems are common to any high-pressure discharge lamps including sealed parts, and are not particular to high-pressure mercury lamps.

In light of these problems, an objective of the present invention is to provide a manufacturing method of a high-pressure discharge lamp which causes less devitrification in a light emission part of a translucent vessel and prevent an internal surface of the light emission part from blackening, even when the high-pressure discharge lamp is configured to have a high output and a high internal pressure. The present invention also aims to provide such a high-pressure discharge lamp, and a lamp unit and an image display apparatus using the high-pressure discharge lamp.

DISCLOSURE OF THE PRESENT INVENTION

Inventors of the present invention first attempted to identify a cause of the above problems. As a result, they obtained the following conclusion. Alkali metals contained in VyCor glass and mercury bromide are interfused into a discharge space in a light emission part as impurities when a high-pressure discharge lamp is lit. The alkali metals chemically react with a material forming the light emission part, which has significantly high temperature. This causes devitrification.

Furthermore, the interfused alkali metals interrupt a halogen cycle, so that the halogen cycle does not work. Therefore, a material (tungsten) forming electrodes evaporates while the high-pressure discharge lamp is lit, and is deposited on the internal surface of the light emission part. This causes blackening.

When the high-pressure discharge lamp is lit in such a state that a lengthwise axis of a translucent vessel is substantially orthogonal to the vertical direction, a highest portion of the internal surface of the light emission part significantly devitrifies. This is thought to be because that portion has the highest temperature due to thermal convection.

In addition, even in a case where VyCol glass and mercury bromide are not used to form the lamp, devitrification and blackening may occur when the constituents (e.g. electrodes and quartz glass) of the lamp contain a great deal of alkali metals, or when a great deal of alkali metals are interfused into the light emission part of the translucent vessel during the manufacturing process.

Considering these, the above objective can be attained by a manufacturing method of a high-pressure discharge lamp that includes a translucent vessel part of which is a light emission part. Here, the manufacturing method includes a lamp formation step of disposing a pair of electrodes in a glass bulb that is to be formed into the translucent vessel, enclosing a light emitting substance and a halogen in the glass bulb, and sealing the glass bulb airtight, to form a semifinished high-pressure discharge lamp, and an electric field application step of applying an electric field to the light emission part, while maintaining at least the light emission part at a predetermined temperature or higher.

According to this method, the electric field is applied to the light emission part. Thus, impurities, especially alkali metals, within a discharge space in the light emission part and contained in constituents (e.g. quartz glass and the electrodes) of the lamp are attracted outside the discharge space during the manufacturing process of the lamp. Furthermore, the impurities are diffused within the material forming the translucent vessel, to be finally dissipated outside the translucent vessel.

This can reduce devitrification of the light emission part, and prevent blackening of an internal surface of the light emission part while the lamp is used. Here, since at least the light emission part of the translucent vessel is kept at a predetermined temperature or higher, a diffusion speed of the impurities in the material forming the light emission part can be increased.

Here, the impurities include general metal elements such as aluminum that can turn into positive ions, and molecular impurities with charges, in addition to alkali metals. The alkali metals here indicate six elements of lithium (Li), sodium (Na), potassium (K), rubidium (Rb), cesium (Cs), and francium (Fr).

The lamp formation step according to the present invention can provide a high-pressure discharge lamp in which arc discharge can be generated between electrodes by application of power to the electrodes. The predetermined temperature can be appropriately determined considering the diffusion speed of the impurities in the material forming the translucent vessel. In the case where the translucent vessel is made of quartz glass, the predetermined temperature preferably falls within a range of 600° C. to 1,100° C., inclusive.

The impurities practically have positive or negative charges, to be attracted by the electric field. The impurities are thought to diffuse in the material forming the translucent vessel, in the state of ions.

Here, the electric field application step may be performed by providing a conductive member outside the translucent vessel, and applying voltages different in potential to the conductive member and the pair of electrodes. Alternatively, the electric field application step may be performed by providing a first conductive member and a second conductive member in such a manner that at least the light emission part of the translucent vessel is placed between the first conductive member and the second conductive member, and applying voltages different in potential to the first conductive member and the second conductive member.

Here, in the electric field application step, at least the light emission part may be heated so as to be maintained at the predetermined temperature or higher, by supplying power to the electrodes to light the semifinished high-pressure discharge lamp. According to this construction, the light emission part can be kept at the predetermined temperature or higher, without requiring special heating equipment. This can contribute to reduction in equipment cost. At the same time, the lighting of the high-pressure discharge lamp for the heating of the light emission part can also serve as lighting performance testing, which is normally performed during the manufacturing process. Therefore, the impurities can be efficiently eliminated in a short time.

Here, the translucent vessel further has sealed parts formed at different ends of the light emission part, and the electrodes are arranged so as to substantially oppose each other, and in the electric field application step, the conductive member is provided in a vicinity of, or in contact with a boundary portion between the light emission part and each of the sealed parts. Here, in the electric field application step, it is preferable that the translucent vessel is kept in a state that a lengthwise axis of the translucent vessel is substantially orthogonal to the vertical direction.

When the high-pressure discharge lamp is lit in such a state that the lengthwise axis of the translucent vessel is substantially orthogonal to the vertical direction, an external surface of the boundary portion between the light emission part and each of the sealed parts has a relatively low temperature, across an external surface of the light emission part and neighboring areas, as long as a portion of the translucent vessel is not locally cooled down or heated up. For this reason, even if the impurities, especially alkali metals, are attracted to the boundary portion, the alkali metals are not likely to chemically react with a portion of the translucent vessel corresponding to the boundary portion. Thus, a risk of devitrification can be reduced. Even if the portion of the translucent vessel corresponding to the boundary portion devitrifies, the devitrification is limited, and does not lead to deformation or breakage of the translucent vessel. In addition, since the portion of the translucent vessel corresponding to the boundary portion is positioned in the vicinity of a foot portion of each electrode, the luminous flux is not reduced.

Here, in the electric field application step, the conductive member is provided neither in a vicinity of, nor in contact with an upper portion of an external surface of the light emission part.

When the high-pressure discharge lamp is lit in such a state that the lengthwise axis of the translucent vessel is substantially orthogonal to the vertical direction, an upper portion of an external surface of the light emission part has a higher temperature than a remaining portion, because of thermal convection within the space in the light emission part. Therefore, if the impurities, especially alkali metals, are mainly attracted to the portion positioned on the upper side, the portion is very likely to devitrify. The method described above can prevent the impurities, especially alkali metals, from being mainly attracted to the upper portion of the external surface of the light emission part. Hence, the method can reduce the devitrification in the portion positioned on the upper side.

Here, each of the electrodes may include an electrode rod, in the lamp formation step, each of the electrodes may be disposed so that a portion of the electrode rod is placed within a corresponding one of portions of the glass bulb which are to be formed into the sealed parts of the translucent vessel, and the glass bulb may be sealed in such a state that a glass tube made of a material containing an alkali metal is provided between the portion of the glass bulb to be formed into the sealed part and the portion of the electrode rod which is placed within the portion of the glass bulb to be formed into the sealed part.

Since a portion of each of the electrode rods is sealed using the glass tube made of a material containing alkali metals, the pressure resistance of the high-pressure discharge lamp can be enhanced. The alkali metals contained in the glass tube can be sufficiently eliminated by performing the electric field application step. Therefore, devitrification in the light emission part and blackening of the internal surface of the light emission part can be reduced and prevented, while the lamp is used.

Here, the glass tube can be made of VyCor glass, as an example. It is generally understood that VyCor glass is principally made of silica ($SiO_2$), and further includes aluminum oxide ($Al_2O_3$), boron oxide ($B_2O_3$), sodium oxide ($Na_2O$) and the like. An example composition ratio of VyCor glass is 96 weight percent or more of $SiO_2$, 0.5 weight percent of $Al_2O_3$, 3.0 weight percent of $B_2O_3$, and 0.04 weight percent of $Na_2O$.

Here, the electrodes may be principally made of tungsten, and include an alkali metal of more than 12 ppm.

According to the manufacturing method, alkali metals contained in the electrodes can be sufficiently eliminated during the manufacturing process. This can reduce devitrification of the light emission part, and prevent blackening of the internal surface of the light emission part, while the lamp is used.

Here, the halogen may be mercury halide.

According to the manufacturing method, impurities, especially alkali metals, contained in the mercury halide can be sufficiently eliminated. This can reduce devitrification of the light emission part, and prevent blackening of the internal surface of the light emission part, while the lamp is used.

There is no particular limitation to the halogen. However, bromine is preferable as it has a small corrosive action into the electrodes. In particular, mercury bromide ($HgBr_2$) is preferable.

According to a high-pressure discharge lamp that is manufactured using the above manufacturing method, impurities, especially alkali metals, contained in a space within the light emission part are sufficiently eliminated. This can reduce devitrification in the light emission part and prevent blackening of the internal surface of the light emission part, while the lamp is used. As a result, the high-pressure mercury lamp has a long lifetime.

Here, the objective is attained by a high-pressure discharge lamp including a translucent vessel made of glass and having (i) a light emission part that has a pair of electrodes and a light emitting metal therein, and (ii) sealed parts formed at different ends of the light emission part, and an attracting means attracting impurities within a space in the light emission part, to a portion of an internal surface of the light emission part, which is not a hottest portion while the high-pressure discharge lamp is lit, the attraction of the impurities occurring due to application of an electric field to at least the light emission part.

According to this construction, while the high-pressure discharge lamp is lit in a steady state, impurities, especially alkali metals, contained within the space in the light emission part are attracted to a portion of the internal surface of the light emission part, which is not the hottest portion. Here, the hottest portion is most likely to devitrify. Thus, the alkali metals are less likely to be deposited on the hottest portion of the internal surface of the light emission part. This can lower a progression rate of devitrification in the hottest portion. In addition, a halogen cycle is not interrupted by the alkali metals, which prevents the internal surface of the light emission part from blackening.

Here, the hottest portion of the internal surface of the light emission part is generally a portion which is positioned the highest, when the lamp is lit in a steady state.

Here, the attracting means preferably attracts the impurities to a coldest portion of the internal surface of the light emission part while the high-pressure discharge lamp is lit.

According to this construction, while the high-pressure discharge lamp is lit in a steady state, the impurities, especially alkali metals, contained within the space in the light emission part can be attracted to the coldest portion of the space in the light emission part. Here, a portion of the translucent vessel which is positioned around the coldest portion is less likely to devitrify. Thus, the alkali metals are less likely to be deposited on the hottest portion of the internal surface of the light emission part. This can lower the progression rate of devitrification in the hottest portion. In addition, a halogen cycle is not interrupted by the alkali metals, which prevents the internal surface of the light emission part from blackening.

Here, when the high-pressure discharge lamp is lit in such a state that a lengthwise axis of the translucent vessel is substantially orthogonal to the vertical direction, the coldest portion of the internal surface of the light emission part is a portion positioned in a vicinity of a foot portion of each of the electrodes.

Here, the attracting means includes a conductive member (i) which is provided outside the translucent vessel, in a vicinity of, or in contact with a boundary portion between the light emission part and each of the sealed parts, and (ii) to which a negative potential, with respect to a potential of the electrodes, is applied while the high-pressure discharge lamp is lit.

According to this construction, while the high-pressure discharge lamp is lit in a steady state, the impurities, especially alkali metals, contained within the space in the light emission part can be attracted to the coldest portion of the space in the light emission part, in other words, quarts glass forming portions of the translucent vessel positioned in the vicinity of foot portions of the electrodes, which are less likely to devitrify. Thus, the alkali metals are less likely to be deposited on the hottest portion of the internal surface of the light emission part. This can reduce the progression rate of devitrification in the hottest portion. There is a slight risk that the attracted alkali metals may chemically react with quartz glass in the vicinity of the foot portions, to cause the quartz glass to devitrify. However, because the temperature of the portions of the translucent vessel in the vicinity of the foot portions is low, the devitrification is limited, and does not lead to deformation or breakage of the translucent vessel. In addition, since the devitrification occurs in the vicinity of the foot portions of the electrodes, the luminous flux is not significantly reduced. Furthermore, a halogen cycle is not interrupted by the alkali metals, which prevents the internal surface of the light emission part from blackening.

Here, the objective is attained by a high-pressure discharge lamp including a translucent vessel made of glass and having (i) a light emission part that has a pair of electrodes and a light emitting metal therein, and (ii) sealed parts formed at different ends of the light emission part, and a conductive member provided outside the translucent vessel, in a vicinity of, or in contact with a boundary portion between the light emission part and each of the sealed parts. Here, when the high-pressure discharge lamp is lit, a voltage that has a negative potential, with respect to a voltage applied to the electrodes, is applied to the conductive member.

According to this construction, impurities, especially alkali metals, contained within the space in the light emission part are not attracted to a portion of an external surface of the light emission part corresponding to the hottest portion of the internal surface of the light emission part. Thus, the alkali metals are less likely to be deposited on the hottest portion of the internal surface of the light emission part. This can lower the progression rate of devitrification in the hottest portion.

Here, the objective is attained by a lamp unit configured so that the above-described high-pressure discharge lamp is mounted in a concave reflector, in such a manner that a middle point between the electrodes substantially coincides with a focal point of the concave reflector.

This lamp unit uses a high-pressure discharge lamp in which devitrification in a light emission part and blackening of an internal surface of the light emission part are less likely to occur. Thus, the lamp unit can achieve a higher illuminance maintenance factor, and a longer lifetime.

Here, the objective is attained by an image display apparatus including the above-described lamp unit, a lighting device to light the high-pressure discharge lamp in the lamp unit, a collecting unit collecting light emitted from the lamp unit, an image formation unit forming an image based on light collected by the collecting unit, and a projecting unit projecting the image formed by the image formation unit, on a screen.

This image display apparatus uses a lamp unit that has an improved illuminance maintenance factor, as a light source. Therefore, the image display apparatus has a higher illuminance maintenance factor regarding an image projected on a screen or the like. In addition, change of the lamp unit is required less often, which can reduce a maintenance cost.

BRIEF DESCRIPTION OF THE DRAWINGS

FIG. 10 is a table showing results of an experiment that compares the high-pressure mercury lamp that is manufactured in the method relating to the first embodiment and a conventional high-pressure mercury lamp.

FIG. 11 is a table showing results of an experiment to evaluate the high-pressure mercury lamp, by varying a level of a voltage applied to a conductive member in the electric field application step in the manufacturing method relating to the first embodiment.

FIG. 16 is a table showing results of an experiment that compares the high-pressure mercury lamp shown in FIG. 15 and a conventional high-pressure mercury lamp.

FIG. 17 is a table showing results of an experiment to evaluate the high-pressure mercury lamp shown in FIG. 15 by varying a level of a voltage applied to a conductive member.

BEST MODE FOR CARRYING OUT THE INVENTION

The following describes embodiments of the present invention with reference to the attached figures.

First Embodiment (1) Construction of Lamp Unit

Figure 1:
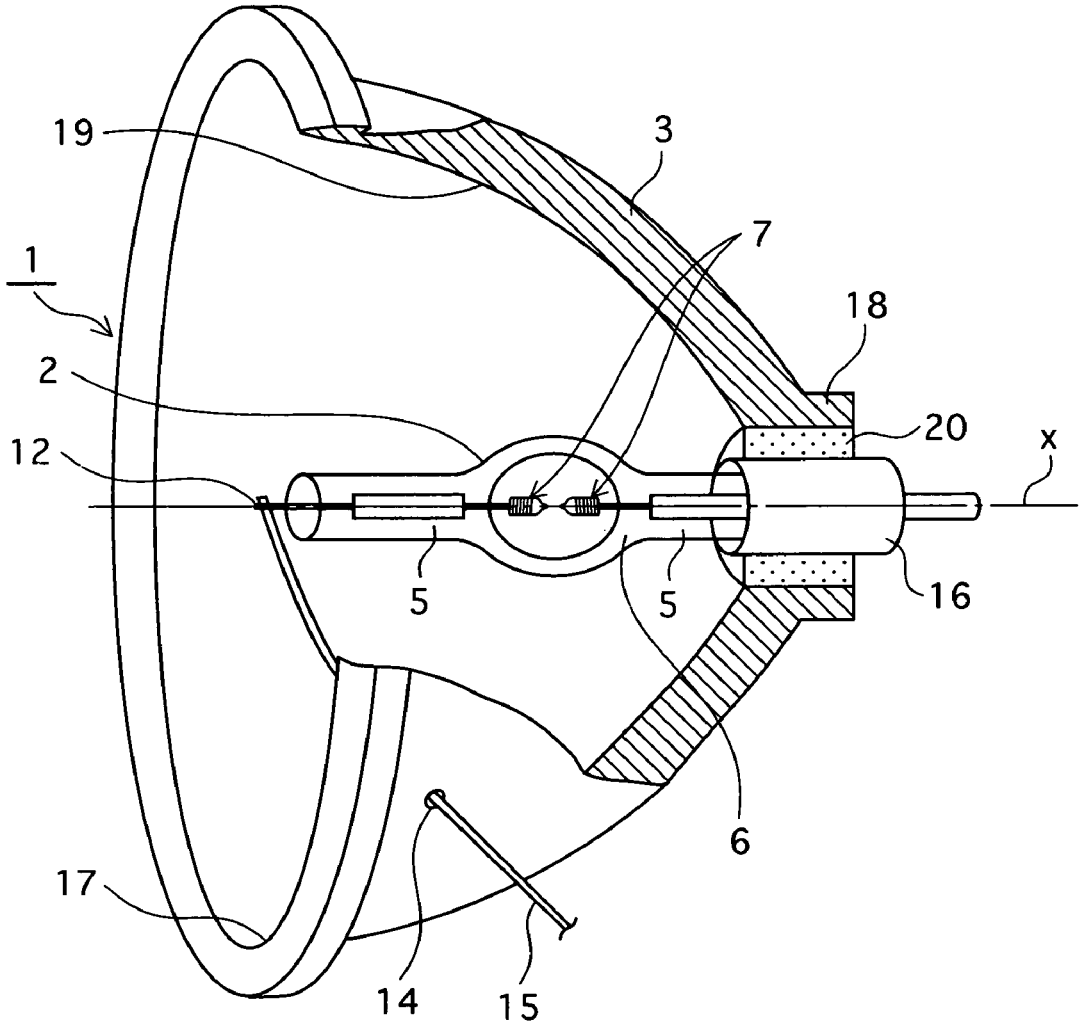
FIG. 1 is a perspective view illustrating a lamp unit for a projector, relating to a first embodiment of the present invention, with a part broken away to show an inner structure.

FIG. 1 is a perspective view illustrating a construction of a lamp unit 1 for a projector, relating to a first embodiment of the present invention, with a part broken away to show an inner structure.

As shown in FIG. 1, the lamp unit 1 includes a high-pressure mercury lamp 2 and a concave reflector 3. Here, the high-pressure mercury lamp 2 is positioned in the concave reflector 3 in such a manner that a middle point between paired electrodes 7 of the high-pressure mercury lamp 2 substantially coincides with a focal point of the concave reflector 3, and that a lengthwise central axis X of the high-pressure mercury lamp 2 is substantially parallel to an optical axis of the concave reflector 3 (In FIG. 1, the lengthwise central axis X coincides with the optical axis.) The high-pressure mercury lamp 2 is an AC-powered type, and has a rated power of 220 W.

The concave reflector 3 has an opening 17 in front, and a neck part 18 at back. An internal surface of the concave reflector 3 is, for example, a paraboloid of revolution, or an ellipsoid of revolution. By depositing a metal on the internal surface, a reflecting surface 19 is formed.

Figure 2:
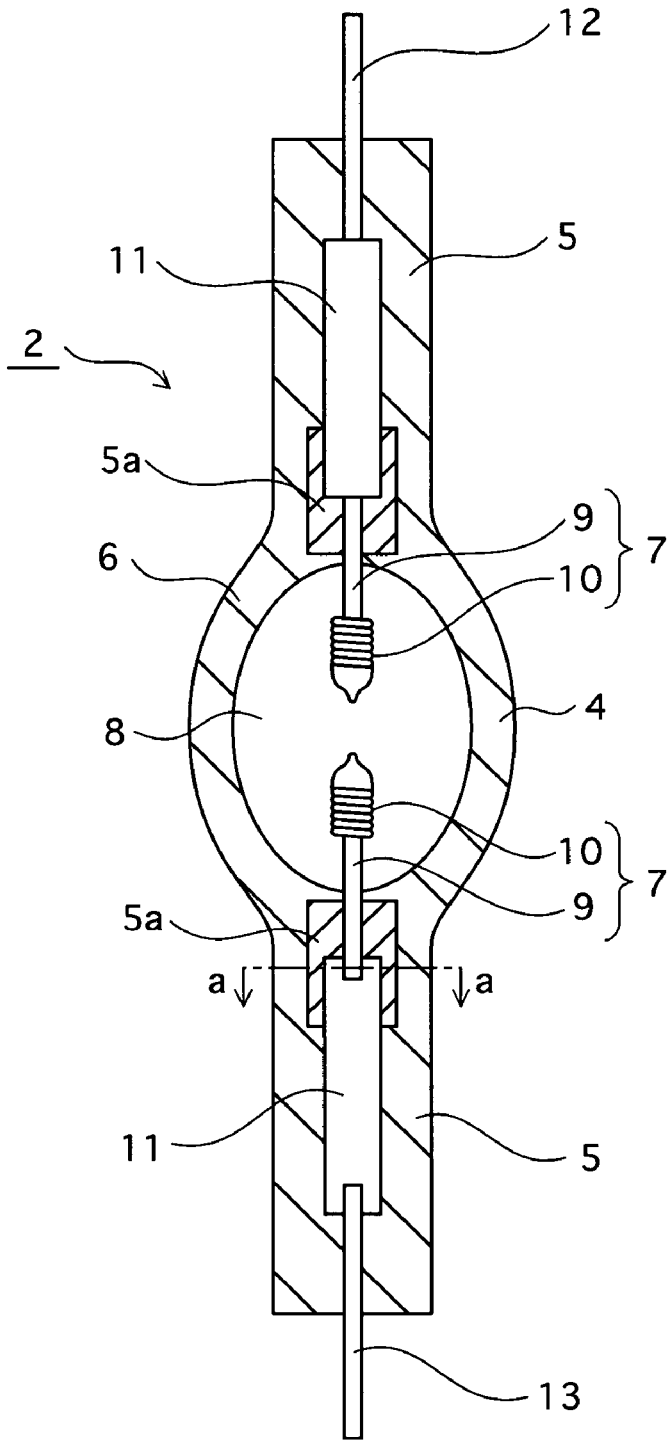
FIG. 2 is a front cross-sectional view illustrating a high-pressure mercury lamp of an alternating-current (AC) powered type, relating to the first embodiment of the present invention.

FIG. 2 is a cross-sectional view illustrating a construction of the high-pressure mercury lamp 2. As shown in FIG. 2, the high-pressure mercury lamp 2 has a translucent vessel 6 made of quartz glass, which includes a light emission part 4 and sealed parts 5. The light emission part 4 has a substantially spherical or ellipsoidal external shape, and has a maximum outside diameter of 12 mm, and a maximum thickness of 2.7 mm to 3 mm. The sealed parts 5 have a shape like a cylinder with a diameter of 6 mm, and are respectively formed at the ends of the light emission part 4.

Here, the maximum outside diameter of the light emission part 4 indicates a maximum outside diameter in a short-axis direction, when the light emission part 4 has a substantially ellipsoidal external shape.

While the high-pressure mercury lamp 2 is lit, a load on an internal surface of the light emission part 4 in the translucent vessel 6 is 60 W/cm$^2$ or more, for example, 140 W/cm$^2$. When the translucent vessel 6 is made of quartz glass, the load on the internal surface of the light emission part 4 is preferably 200 W/cm$^2$ or less for actual operation.

The light emission part 4 has an inner volume of 0.2 cc, for example.

In the light emission part 4, the electrodes 7 are arranged so as to substantially oppose each other, and mercury, a rare gas such as an argon gas and a xenon gas, and a halogen such as bromine is enclosed. Thus, a discharge space 8 is formed.

Here, the amount of the mercury enclosed in the discharge space 8 is 0.15 mg/mm$^3$ or more, preferably 0.35 mg/mm$^3$ or less for actual operation. The amount of the enclosed rare gas is approximately 5 kPa to 40 kPa. The amount of the enclosed halogen is $10^{-7}$ μmol/mm$^3$ to $10^{-2}$ μmol/mm$^3$.

The electrodes 7 are principally made of tungsten. Each electrode 7 is constituted by an electrode rod 9 which has a diameter of 0.3 mm to 0.45 mm and contains impurities such as alkali metals, and a coil 10 which is wound around one of the ends of the electrode rod 9 and has the same components as the electrode rod 9. A top end of the electrode 7 is formed as substantially a sphere, by melting the electrode rod 9 and the coil 10 partly. A distance between the electrodes 7 (inter-electrode distance) falls within a range of 0.2 mm to 5.0 mm.

The other end of the electrode rod 9 is electrically connected to a corresponding one of external lead wires 12 and 13, through a metal foil 11 which is sealed by a corresponding one of the sealed parts 5. The lead wires 12 and 13 and the metal foil 11 are made of molybdenum.

The following shows, as an example, the impurities included in the electrodes 7, and the amount of the impurities.

Potassium 10 ppm

Sodium 20 ppm

In each of the sealed parts 5, a glass member 5*a* is provided between a portion of the electrode rod 9 which is placed in the sealed part 5 and quartz glass forming the sealed part 5. The glass member 5*a* is made of VyCor glass of Corning, Inc., and has a tubular shape. Through the glass member 5*a*, the electrode rod 9 is sealed.

Figure 3:
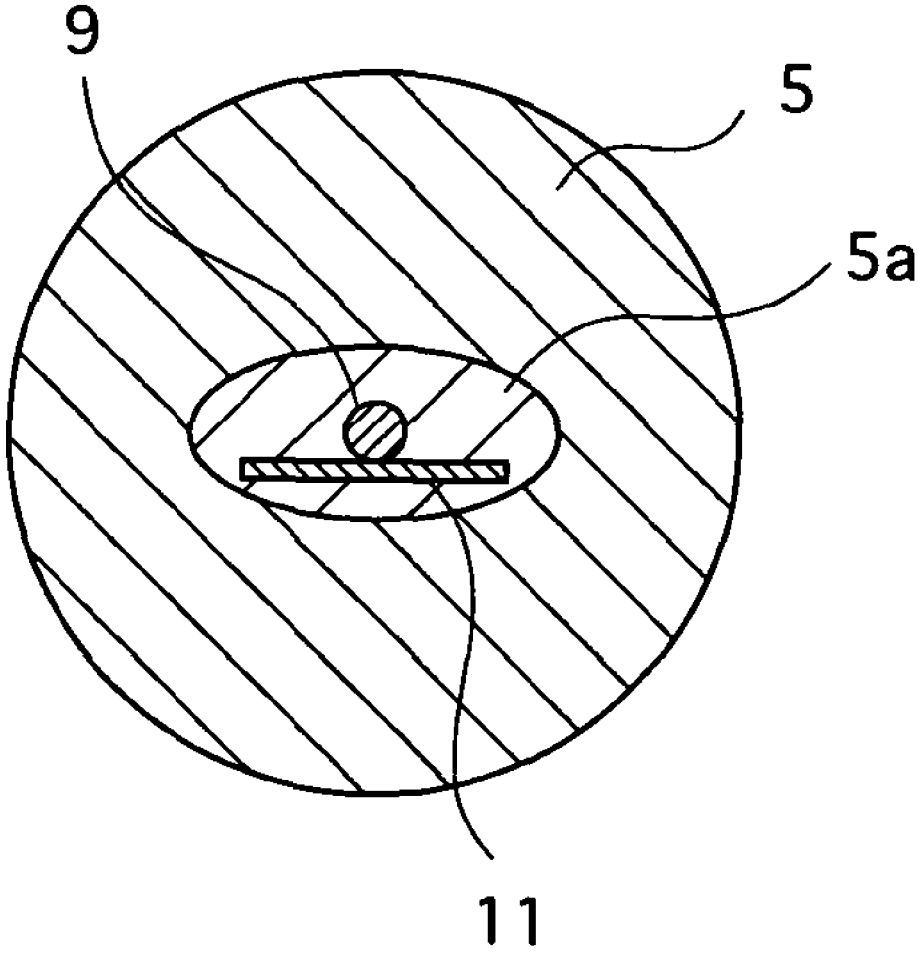
FIG. 3 is a cross-sectional view illustrating a sealed part along a line a-a shown in FIG. 2.

FIG. 3 is a transverse cross-sectional view illustrating the sealed part 5 along a line a-a shown in FIG. 2. As shown in FIG. 3, a transverse cross-section of the sealed part 5 is substantially circular. The metal foil 11 and the electrode rod 9 are sealed airtight through the glass member 5*a*.

The following shows components of the glass member 5*a*.

$SiO_2$: 96 weight percent or more $Al_2O_3$: 0.5 weight percent $B_2O_3$: 3.0 weight percent $Na_2O$: 0.04 weight percent Turning back to FIG. 2, an end of the metal foil 11 which is opposite to an end connected to the electrode rod 9 is connected to a corresponding one of the external lead wires 12 and 13. An end of each of the external lead wires 12 and 13 which is opposite to an end connected to the metal foil 11 extends outside the translucent vessel 6.

Among the external lead wires 12 and 13, the external lead wire 12 is electrically connected to a power supplying line 15 as shown in FIG. 1. The power supplying line 15 extends, through a thorough hole 14 which is formed in the concave reflector 3, outside the concave reflector 3. The external lead wire 13 (not shown in FIG. 1) is electrically connected to a cap 16. The cap 16 is fixed to one end of one of the sealed parts 5 of the high-pressure mercury lamp 2, using an adhesive agent (not shown in FIG. 1). By inserting the cap 16 into the neck part 18 of the concave reflector 3 and fixing the cap 16 and the neck part 18 together using an adhesive agent 20, the high-pressure mercury lamp 2 is combined with the concave reflector 3.

A front glass (not shown in FIG. 1) is fixed to the opening 17 of the concave reflector 3 using an adhesive agent or the like. The front glass prevents intrusion of dusts and the like into the inside the concave reflector 3.

(2) Construction of Lighting Device

The following describes a lighting device to light the high-pressure mercury lamp 2.

Figure 4:
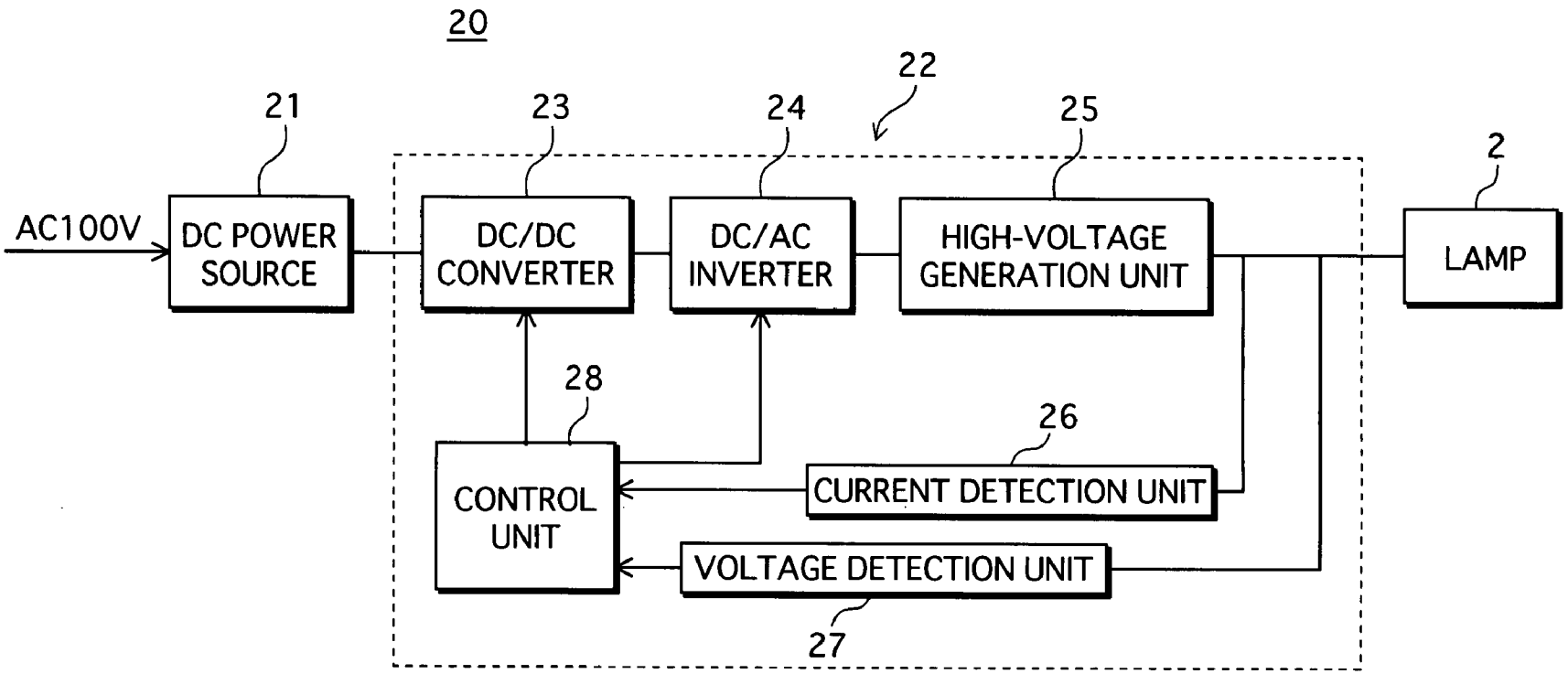
FIG. 4 is a block diagram illustrating a construction of a lighting device to light the high-pressure mercury lamp.

As shown in FIG. 4, a lighting device 20 includes a direct-current (DC) power source 21 and a ballast 22. The DC power source 21 is connected to an AC power source (AC 100 V) (not shown in FIG. 4). The ballast 22 is connected to the DC power source 21 and to the high-pressure mercury lamp 2.

The ballast 22 includes a DC/DC converter 23, a DC/AC inverter 24, a high-voltage generation unit 25, a current detection unit 26, a voltage detection unit 27, and a control unit 28. The DC/DC converter 23 supplies power required to light the high-pressure mercury lamp 2. The DC/AC inverter 24 converts an output of the DC/DC converter 23 into AC currents of a predetermined frequency. The high-voltage generation unit 25 superposes a high-voltage pulse with the high-pressure mercury lamp 2, for the high-pressure mercury lamp 2 to start emitting light. The current detection unit 26 detects a lamp current applied to the high-pressure mercury lamp 2. The voltage detection unit 27 detects a lamp voltage applied to the high-pressure mercury lamp 2. The control unit 28 controls the DC/DC converter 23 and the DC/AC inverter 24, based on detection signals received from the current detection unit 26 and the voltage detection unit 27. The ballast 22 performs a control so that a constant level of power is supplied to the high-pressure mercury lamp 2.

(3) Construction of Image Display Apparatus

Figure 5:
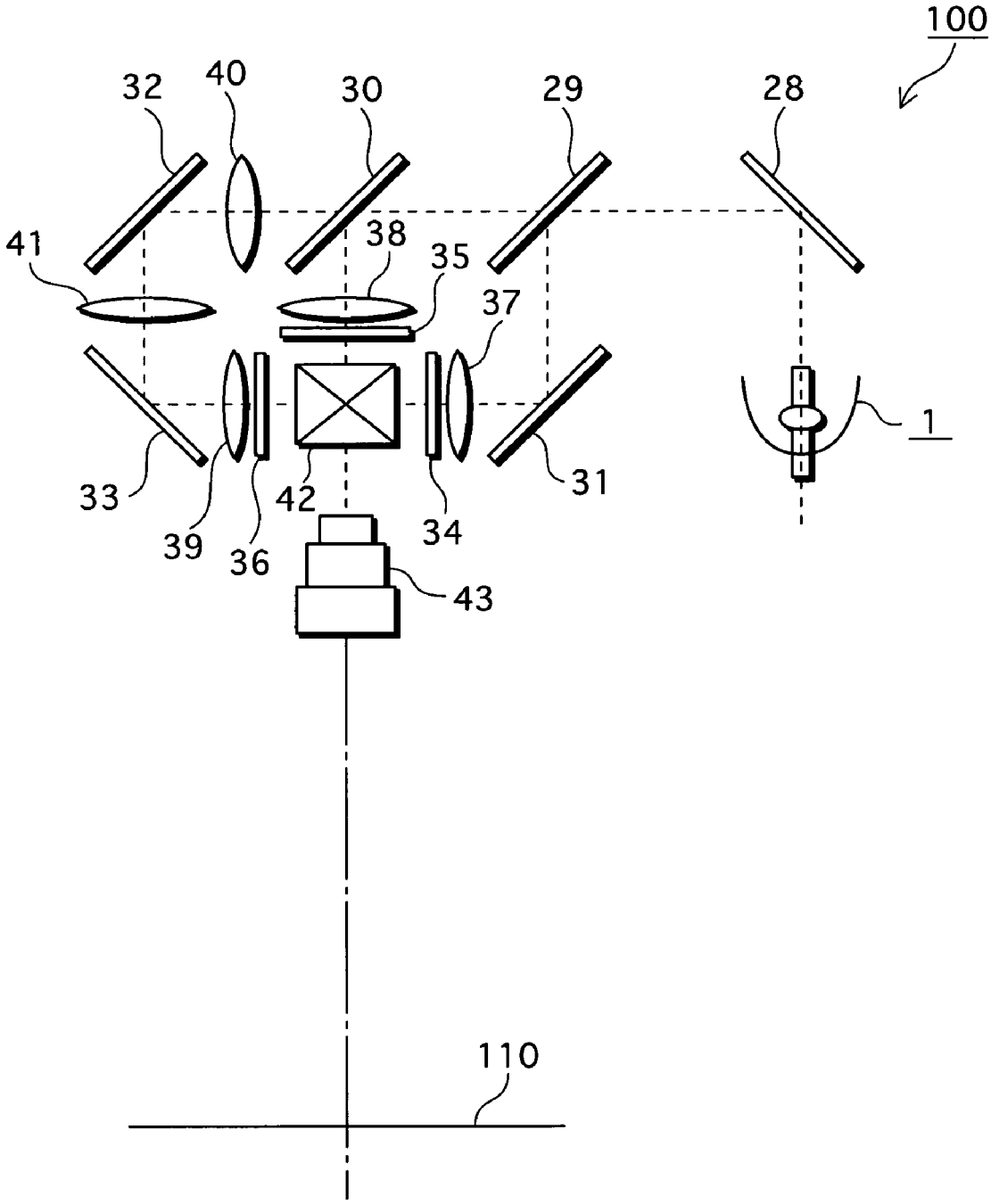
FIG. 5 is a schematic view illustrating an example construction of an image display apparatus using the lamp unit relating to the first embodiment of the present invention.

The following describes a construction of an image display apparatus using the lamp unit 1, taking a 3CCD liquid crystal projector as an example, with reference to FIG. 5.

As shown in FIG. 5, a 3CCD liquid crystal projector 100 includes the lamp unit 1, a mirror 28, dichroic mirrors 29 and 30, mirrors 31, 32 and 33, liquid crystal light bulbs 34, 35 and 36, field lenses 37, 38 and 39, relay lenses 40 and 41, a dichroic prism 42, and a projection lens 43. The lamp unit 1 serves as a light source. The dichroic mirrors 29 and 30 separate white light emitted from the lamp unit 1, into three primary colors of blue, green and red. The mirrors 31, 32 and 33 each reflect light of a corresponding one the colors. The liquid crystal light bulbs 34, 35 and 36 respectively form monochromatic images of the three primary colors. The dichroic prism 42 combines the light that have passed through the liquid crystal light bulbs 34, 35 and 36. An image obtained by the 3CCD liquid crystal projector 100 is projected on a screen 110, which is a projected surface.

It should be noted that constituents of this image display apparatus 100 are publicly known, except for the lamp unit 1. Therefore, an optical device such as a UV filter is not explained in the above description.

(4) Manufacturing Method of the High-Pressure Mercury Lamp 2

The following describes a manufacturing method of the high-pressure mercury lamp 2.

This manufacturing method can be broadly divided into a lamp formation step and an electric field application step.

(4-1) Lamp Formation Step

Figure 6:
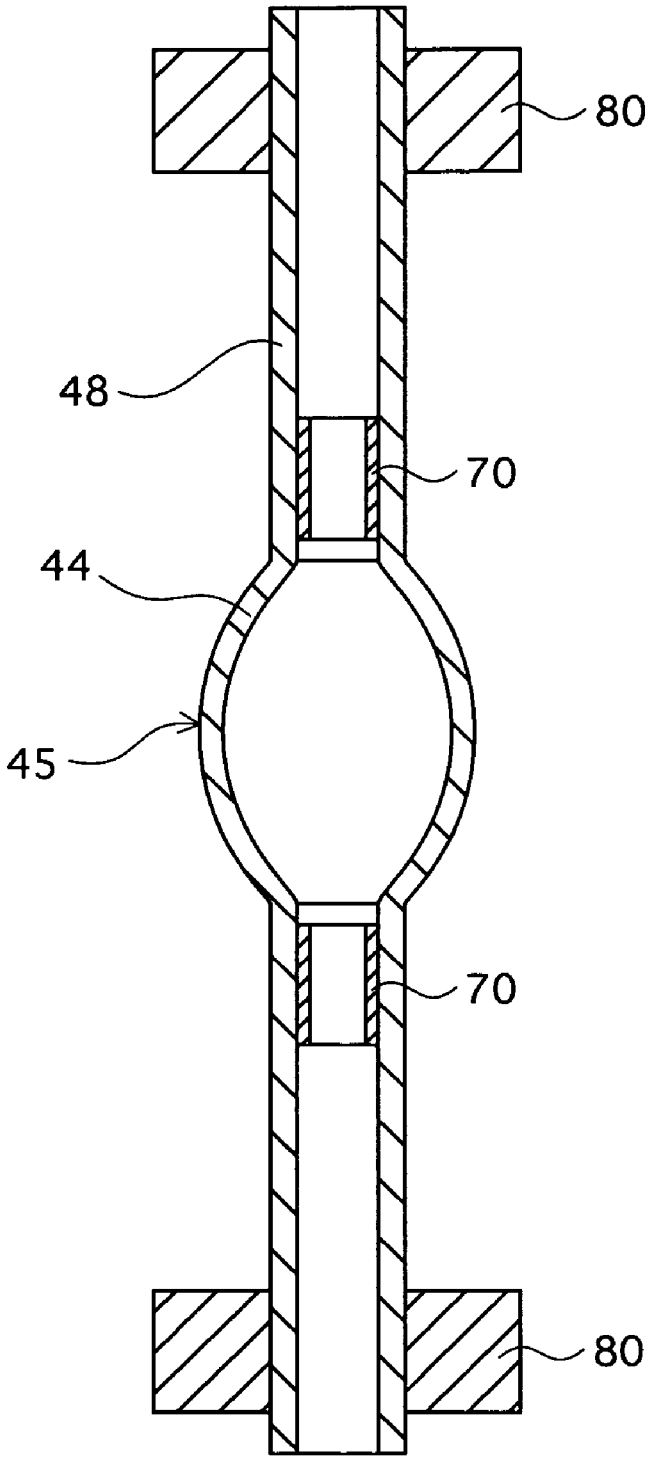
FIG. 6 is used to illustrate an initial stage of a lamp formation step included in a manufacturing method of the AC-powered high-pressure mercury lamp used for the lamp unit.

A glass bulb 45 is formed by processing a pipe made of quartz glass. The glass bulb 45 has a part 44, in its middle, which is to be formed into the light emission part 4, and parts 48 and 50 which are to be formed into the sealed parts 5. The part 44 is swollen by the processing, to have a substantially spherical or ellipsoidal shape. The parts 48 and 50 extend from different ends of the part 44. A glass tube 70 made of VyCor glass is inserted into each of the parts 48 and 50, to be positioned as shown in FIG. 6. Then, a portion of each of the parts 48 and 50 corresponding to the glass tube 70 is externally heated, so that an external surface of the glass tube 70 is made in contact with, and fixed to an internal surface of each of the parts 48 and 50. After this, the inside of the glass bulb 45 is washed thoroughly and dried.

Figure 7:
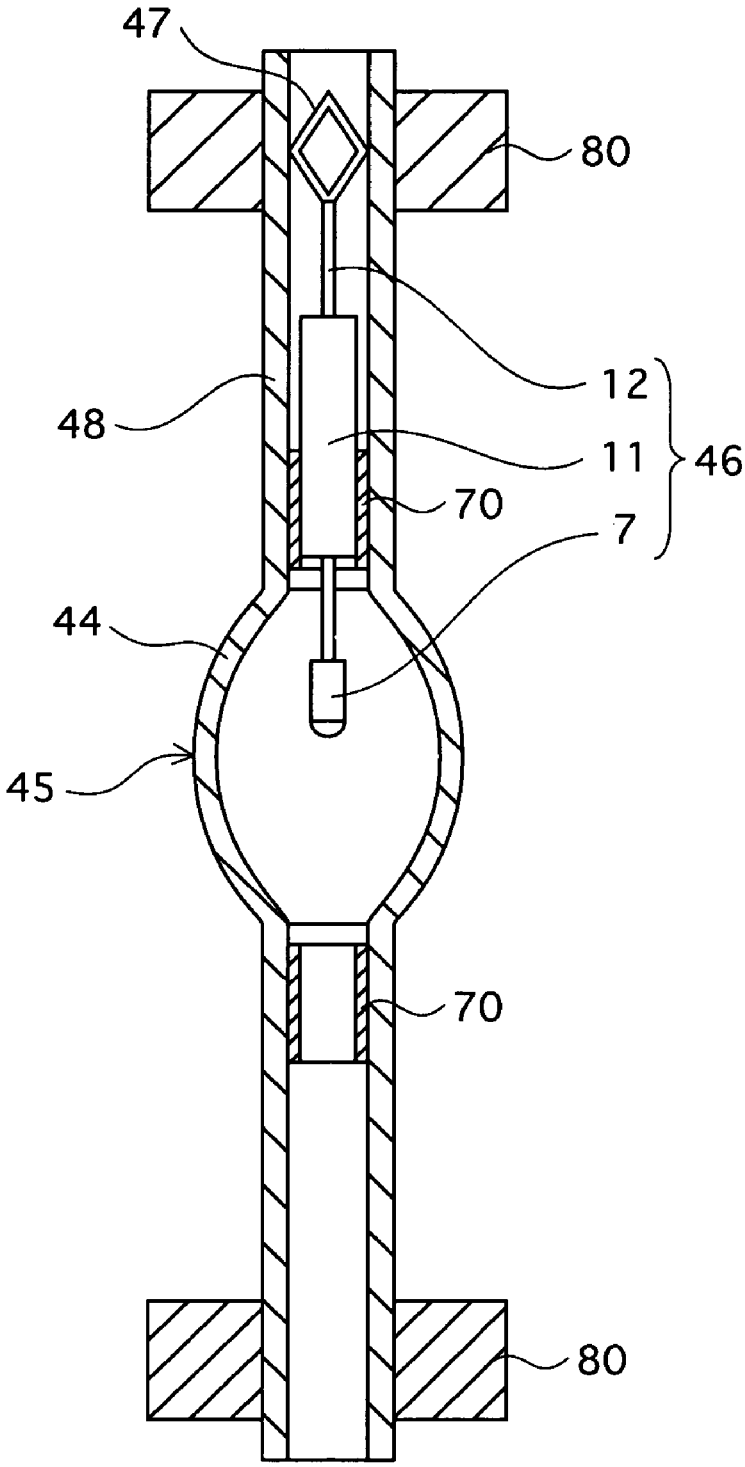
FIG. 7 is used to illustrate a next stage of the lamp formation step included in the manufacturing method of the AC-powered high-pressure mercury lamp used for the lamp unit.

Subsequently, as shown in FIG. 7, the glass bulb 45 is kept upright, and a first electrode assembly 46 is inserted in the glass bulb 45 from an upper end, to be held at a predetermined position by a holding jig 47. Here, the first electrode assembly 46 is, in advance, formed by one of the electrodes 7, one of the metal foils 11, and the external lead wire 12.

After this, the part 48 in which the first electrode assembly 46 is positioned is heated by a gas burner or the like, to be softened and sealed.

Figure 8:
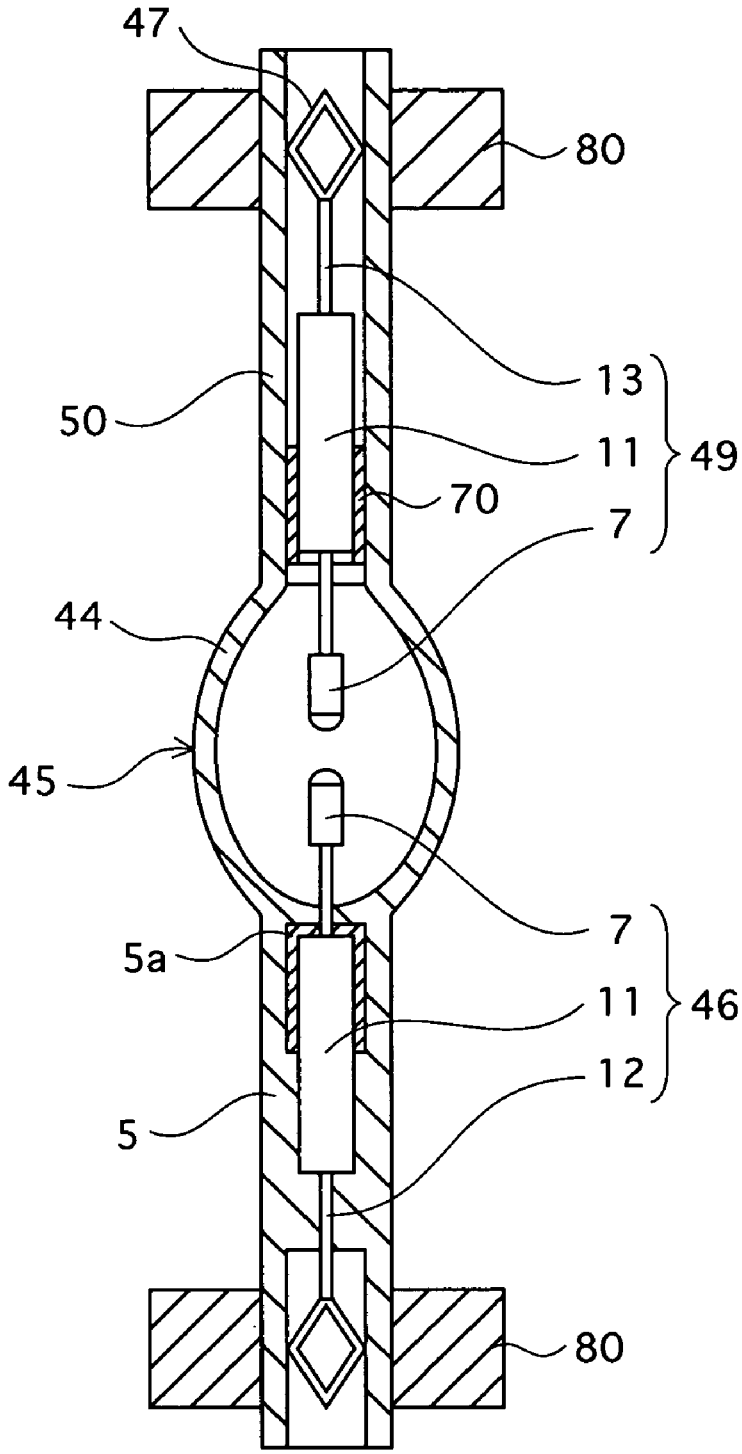
FIG. 8 is used to illustrate a next stage of the lamp formation step included in the manufacturing method of the AC-powered high-pressure mercury lamp used for the lamp unit.

Subsequently, the glass bulb 45 is kept in such a manner that the part 48 that has been sealed is positioned lower, as shown in FIG. 8. A predetermined amount of mercury bromide and a predetermined amount of pure mercury are introduced into the glass bulb 45 from an upper end. After this, a second electrode assembly 49 is inserted into the glass bulb 45 from the upper end, to be held at a predetermined position by the holding jig 47. Here, the second electrode assembly 49 is, in advance, formed by the other electrode 7, the other metal foil 11, and the external lead wire 13. After this, the glass bulb 45 is evacuated, and a predetermined amount of rare gas is enclosed.

After this, while the part 44 is cooled down by liquid nitrogen or the like, the part 50 in which the second electrode assembly 49 is positioned, is heated by a gas burner or the like, to be softened and sealed.

Lastly, unnecessary portions at both ends of the glass bulb 45 are cut off, so that the high-pressure mercury lamp 2 is completed as shown in FIG. 2. In other words, at this stage of the manufacturing method, if the external lead wires 12 and 13 are connected to the lighting device 20 shown in FIG. 4, for example, so that power is supplied to the pair of electrodes 7, arc discharge occurs between the electrodes 7.

Note that the step described above is publicly known, and therefore not elaborated in detail. Furthermore, the high-pressure mercury lamp 2 can be completed using any of publicly-known methods other than the above-described method.

(4-2) Electric Field Application Step

Figure 9:
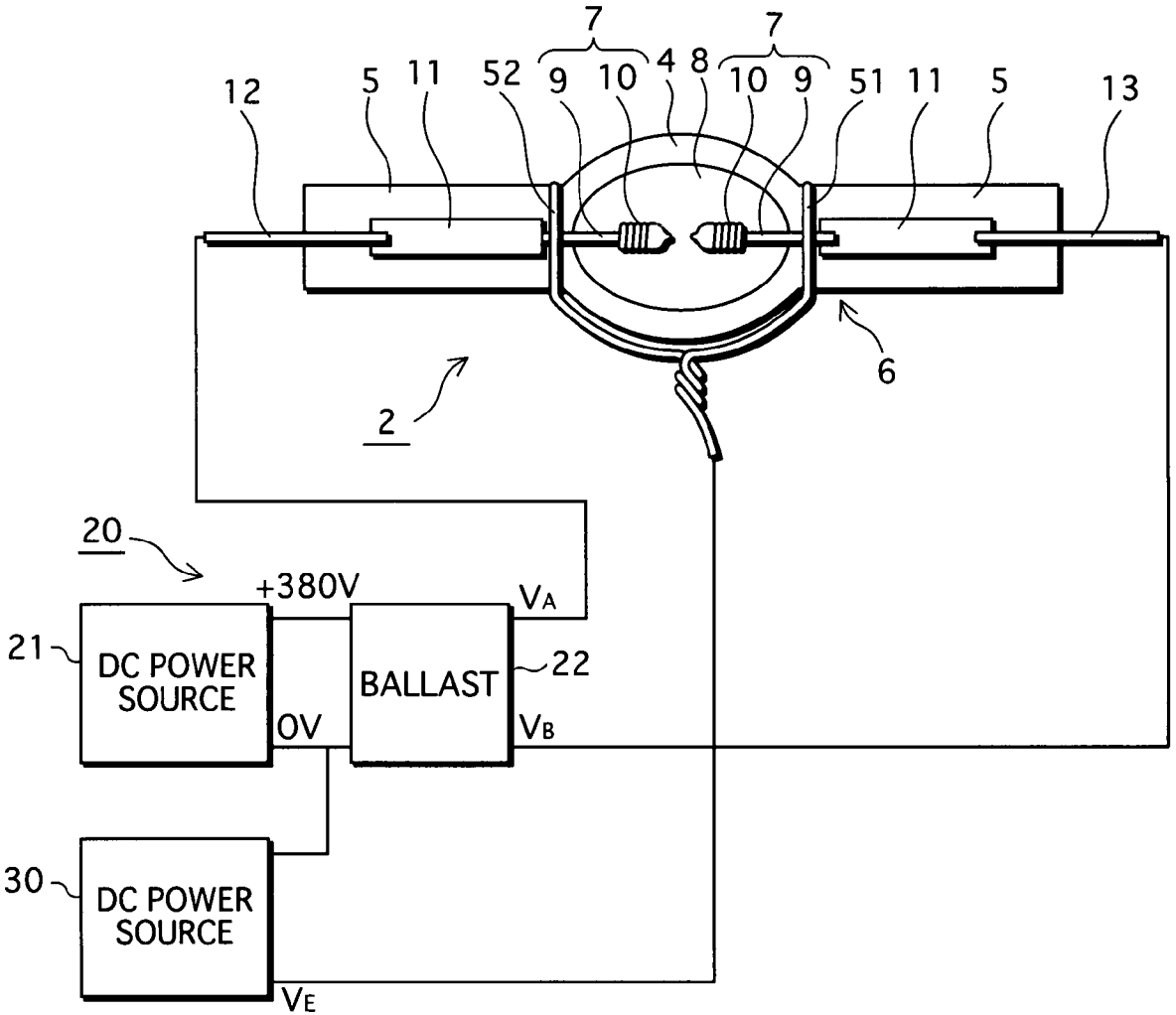
FIG. 9 is used to illustrate an electric field application step included in the manufacturing method of the AC-powered high-pressure mercury lamp used for the lamp unit.

After the above-described lamp formation step, the high-pressure mercury lamp 2 is kept, as shown in FIG. 9, in such a manner that a lengthwise axis of the translucent vessel 6 (same as the central axis X) is substantially orthogonal to the vertical direction (this state is hereinafter referred to as "horizontally kept").

Wire-like conductive members 51 and 52 are wound once around boundary portions of the translucent vessel 6 between the light emission part 4 and the sealed parts 5. The conductive members 51 and 52 are in the vicinity of, or in contact with external surfaces of the boundary portions. The conductive members 51 and 52 are made of an alloy of iron, chrome and aluminum, and have a diameter of 0.2 mm to 0.5 mm, for example, 0.2 mm.

The conductive members 51 and 52, after being wound around the boundary portions between the light emission part 4 and the sealed parts 5, are positioned so as to run along a lower portion of an external surface of the light emission part 4, when the high-pressure mercury lamp 2 is lit in the state of being horizontally kept. Here, the conductive members 51 and 52 are in the vicinity of, or in contact with the external surface of the lower portion of the light emission part 4. The conductive members 51 and 52 are then twisted together in the middle of the external surface of the lower portion of the light emission part 4, to be connected with each other.

This construction has the following reason. When the high-pressure mercury lamp 2 is lit in the state of being horizontally kept, an upper portion of an external surface of the light emission part 4 has the highest temperature. Hence, to avoid providing the conductive members 51 and 52 in the vicinity of the hottest portion, the conductive members 51 and 52 are connected to each other on the lower side of the light emission part 4, and provided in the vicinity of the external surface of the portion of the light emission part 4 whose internal surface has a relatively low temperature.

The external lead wires 12 and 13 of the high-pressure mercury lamp 2 are connected to the lighting device 20 shown in FIG. 4. At the same time, the conductive members 51 and 52 are connected to one of the terminals of a DC power source 30. Here, the other terminal of the DC power source 30 and a 0-V side of the DC power source 21 in the lighting device 20 are connected to each other at the same potential.

It is assumed that the AC-powered high-pressure mercury lamp 2 with a rated power of 220 W is lit using the lighting device 20, as an example. In this case, the lighting device 20 is configured so that, with respect to a potential (0 V) of one of the terminals of the DC power source 21, the other terminal of the DC power source 21 can have a potential of 380 V, and that the terminal of the DC power source 30 which is connected to the conductive members 51 and 52 can have a potential $V_E$ of −50V or lower.

Accordingly, if the high-pressure mercury lamp 2 is lit in a steady state, a potential of the electrodes 7 varies in a range from 0 V to 100 V, and the conductive members 51 and 52 are supplied with the potential $V_E$ of −50 V or less, with respect to the potential of one of the terminals of the DC power source 21 (0V).

After the above preparation, the lighting device 20 shown in FIG. 4 causes the high-pressure mercury lamp 2 to consecutively emit light, under conditions substantially the same as conditions where the high-pressure mercury lamp 2 actually operates. In addition, the potential $V_E$ of −50 V or less is applied to the conductive members 51 and 52.

This state is maintained for five minutes or longer, preferably 15 minutes or longer, or two to ten hours or longer, since the start of the potential application.

Because the high-pressure mercury lamp 2 is lit during this time period, at least the light emission part 4 of the translucent vessel 6 is maintained at a predetermined temperature, for example, 800° C. Also, this lighting has a role of a normal lighting performance test.

It is preferable to keep the translucent vessel 6, at least the light emission part 4, at 600° C. or higher in order to sufficiently diffuse impurities, especially ionized alkali metals, in the quartz glass. However, as the translucent vessel 6 is made of quartz glass, it is preferable to keep the translucent vessel 6 at 1,100° C. or lower to prevent recrystallization and devitrification of the quartz glass.

Subsequently, the high-pressure mercury lamp 2 is naturally or forcedly cooled down, and the conductive members 51 and 52 are then removed. Thus, the high-pressure mercury lamp 2 is completed.

(4-3) Verification of Effects

The following describes effects of the lamp unit 1 relating to the first embodiment of the present invention (hereinafter referred to as the present invented product).

After lit for 300 hours, and 2,000 hours, the present invented product is examined as to whether the internal surface of the light emission part 4 blackens or not, and whether devitrification occurs or not. Furthermore, an illuminance maintenance factor (%) of the present invented product is measured. Here, the illuminance maintenance factor is calculated under an assumption that the illuminance of the present invented product observed after lighting for five hours is 100%. A table 1 in FIG. 10 shows results of the examination and the measurement.

The potential $V_E$ applied to the conductive members 51 and 52 is −100 V in the electric field application step, and the above-mentioned illuminance maintenance factor is calculated based on an average illuminance of a 40-inch screen illuminated by the above-described image display apparatus mounted with the lamp unit 1.

For a comparison purpose, the same examination and measurement are performed for a lamp unit (hereinafter referred to as a compared product) including a high-pressure mercury lamp, which has the same construction as the present invented product. This compared product is manufactured in the same manufacturing method as the present invented product, except for that, during the manufacturing process, the compared product is lit solely for a normal lighting performance test, that is to say, without the provision of the conductive members 51 and 52. The table 1 also shows results of the examination and measurement of the compared product.

It should be noted that five present invented products, and five compared products are tested.

As seen from the table 1, even after lighting for 2,000 hours, in the present invented product, devitrification and blackening are hardly found in the light emission part 4, and the illuminance maintenance factor is 74%. In the compared product, however, after lighting for only 300 hours, the internal surface of the light emission part 4 significantly devitrifies and blackens, and the illuminance maintenance factor is 85%. In all of the tested compared products, the light emission part 4 is overheated, to be swollen and therefore be deformed before 2,000 hours elapses since the start of the lighting. This is because the devitrification blocks radiation heat.

As explained above, the manufacturing method of the high-pressure mercury lamp 2 for use in the lamp unit 1 for a projector, relating to the first embodiment of the present invention, has the following advantages. During the manufacturing process of the high-pressure mercury lamp 2, a negative potential, with respect to the potential of the electrodes 7, is applied to the conductive members 51 and 52, to generate an electric field between the electrodes 7 and the conductive members 51 and 52. The electric field causes impurities, especially alkali metals, in the space within the light emission part 4 and contained in constituents of the lamp 2 (the electrodes 7, the enclosed mercury bromide, the glass members 5*a*, and the like) to be attracted toward the conductive members 51 and 52. Thus, the impurities can be diffused within the quartz glass, and finally dissipated outside the translucent vessel 6. This can reduce devitrification of the quartz glass forming the light emission part 4, and prevent the internal surface of the light emission part 4 from blackening, while the high-pressure mercury lamp 2 operates.

Furthermore, since at least the light emission part 4 of the translucent vessel 6 is kept at a predetermined temperature or higher, a diffusion speed of ionized alkali metals in the quartz glass can be increased.

Here, the light emission part 4 is kept at a predetermined temperature or higher by lighting the high-pressure mercury lamp 2, not by special heating equipment. Therefore, the equipment cost can be lowered. Furthermore, the lighting of the high-pressure mercury lamp 2 during the manufacturing process can also serve as a lighting performance test, which is normally performed during the manufacturing process. Hence, the impurities can be eliminated efficiently, in a short time.

The high-pressure mercury lamp 2 is horizontally kept, and the conductive members 51 and 52 are provided in the vicinity of, or in contact with the boundary portions between the light emission part 4 and the sealed parts 5. In this way, the impurities, especially alkali metals, are attracted toward the boundary portions. However, quartz glass forming the boundary portions is unlikely to chemically react with the alkali metals, and therefore has a lower risk of devitrification. The reason for this is explained in the following. As long as a portion of the translucent vessel 6 is not locally cooled down or heated up, external surfaces of the boundary portions between the light emission part 4 and the sealed parts 5 have a relatively low temperature, across an external surface of the light emission part 4 and neighboring portions, while the high-pressure mercury lamp 2 is lit. The quartz glass forming the boundary portions may devitrify, but the devitrification is very limited, and does not lead to deformation or breakage of the quartz glass. In addition, since the boundary portions are positioned in the vicinity of foot portions of the electrodes 7, the luminous flux is not reduced.

Also, the conductive members 51 and 52 are not in the vicinity of, or in contact with the upper portion of the external surface of the light emission part 4. Because of this construction, the impurities, especially alkali metals, are prevented from being attracted to the upper portion of the external surface of the light emission part 4. This can reduce devitrification of quartz glass forming that portion.

Having the high-pressure mercury lamp 2, which is manufactured according to the above-described manufacturing method, as a light source, the lamp unit 1 relating to the first embodiment of the present invention can achieve an enhanced illuminance maintenance factor, and a longer lifetime.

In addition, the image display apparatus using this lamp unit 1 can achieve a higher illuminance maintenance factor on a screen or the like, and a longer lifetime.

(4-4) Optimum Range of Voltage $V_E$ in the Electric Field Application Step

The illuminance maintenance factor (%) of the present invented product is measured after lighting for 1,000 hours, and 2,000 hours, by varying the level of the voltage $V_E$ applied to the conductive members 51 and 52 between 0 V, −25 V, −50 V, −100 V, and −200 V. A table 2 shown in FIG. 11 shows results of the measurement.

As shown in the table 2, when the voltage $V_E$ of −50 V or less, specifically speaking, −50 V, −100 V and −200 V, is applied, the present invented product has the illuminance maintenance factor of 60% or more even after lit for 2,000 hours, and deformation or the like of the translucent vessel 6 does not take place.

When the voltage $V_E$ of over −50 V, for example, −25 V, is applied, on the other hand, the present invented product has the illuminance maintenance factor of 71% after lit for 1,000 hours. However, before 2,000 hours elapses, the translucent vessel 6 is swollen due to devitrification, and therefore deformed.

This proves that, with respect to the potential of the other terminal (0 V) of the DC power source 30, the voltage $V_E$ applied to the conductive members 51 and 52 needs to be −50 V or less during the manufacturing process of the high-pressure mercury lamp 2, in order to sufficiently eliminate the impurities, especially alkali metals. It goes without saying that the lower the level of the voltage $V_E$ is, the more efficiently the impurities are eliminated. However, restrictions of the cost and the circuit of the DC power source 30 determine a lower limit of the level of the voltage $V_E$.

Here, a high-pressure mercury lamp which is manufactured using the method including the above-described electric field application step is different, in terms of the following constructions, from a high-pressure mercury lamp which is not manufactured using the manufacturing method relating to the first embodiment of the present invention.

(a) At an initial stage of lighting of the high-pressure mercury lamp manufactured using the method relating to the first embodiment, emission spectrum due to impurities is significantly reduced. This is because impurities within a discharge space in a light emission part move into a material forming the light emission part or outside the light emission part by application of an electric field. The difference in the emission spectrum is particularly striking, when glass members made of VyCor glass are provided in sealed parts.

(b) The application of the electric field causes a difference in density of impurities between the light emission part and the sealed parts extending from the light emission part. This indicates that the ionized impurities within the discharge space move outward in a wall of the light emission part.

Examination of whether a high-pressure mercury lamp has these two characteristics determines whether the manufacturing method relating to the first embodiment of the present invention is employed.

In particular, a difference in amount of Na is significant. Taking this into consideration, the high-pressure mercury lamp 2 relating to the first embodiment of the present invention may be characterized in that the amount of Na per unit volume is smaller in the light emission part 4 than in the sealed parts 5 extending from the light emission part 4. Here, the amount of Na per unit volume in the light emission part 4 is preferably at least half, or less than half the amount of Na per unit volume in the sealed parts, in the first embodiment.

Figures 12A, 12B:
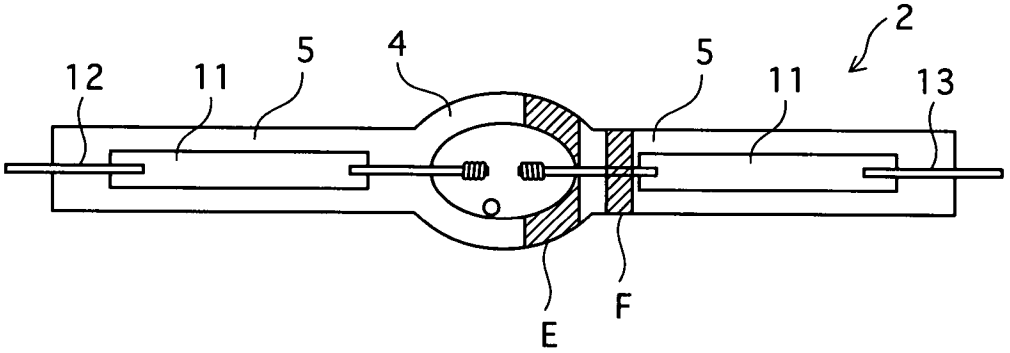
FIG. 12A shows portions, where an amount of Na is measured, in the high-pressure mercury lamp that is manufactured using the method including the electric field application step, relating to the first embodiment.
FIG. 12B is a table showing results of the measurement.

The amount of Na is measured, using atomic absorption photometry, in a conventional high-pressure mercury lamp and the present invented high-pressure mercury lamp which is manufactured according to the method including the electric field application step. Specifically speaking, the amount of Na is measured in a portion E (indicated by diagonal lines) of the light emission part 4 shown in FIG. 12A, and in a portion F (indicated by diagonal lines) of one of the sealed parts 5 where the glass member 5*a* (shown in FIG. 2) is not provided. A table 3 in FIG. 12B shows results of the measurement. It should be noted that the conventional high-pressure mercury lamp and the present invented high-pressure mercury lamp are both lit for two hours.

As clearly seen from the table 3, the amount of Na in the light emission part 4 is 0.61 ppm in the conventional lamp, but 0.11 ppm, i.e. almost one sixth of 0.61 ppm, in the present invented lamp.

It is also confirmed that the amount of hydrogen ($H_2$) in the discharge space 9 is significantly reduced by performing the electric field application step. According to a conventional manufacturing method for a high-pressure mercury lamp, a step of vacuum baking the entire lamp needs to be conducted for a predetermined time period, at an appropriate stage after the lamp is sealed, in order to reduce hydrogen within a discharge space and to eliminate unnecessary distortion of a glass material forming an arc tube. However, this vacuum baking step can be dramatically shortened if the electric field application step is performed.

As described above, if the electric field application step is performed as in the first embodiment, impurities in the light emission part 4 are reduced. This can reduce blackening and prevents devitrification, thereby improving the lifetime of the lamp.

(5) Other Matters (5-1) According to the first embodiment, the conductive members 51 and 52 are wound only once, around the boundary portions between the light emission part 4 and the sealed parts 5. However, the above-described effects can be achieved even if the conductive members 51 and 52 are wound twice or more.

According to the first embodiment, the conductive members 51 and 52 are made of an alloy of iron, chrome and aluminum. However, the above-described effects can be achieved even if the conductive members 51 and 52 are made of a highly heat-resistive metal such as tungsten and molybdenum.

According to the first embodiment, each of the conductive members 51 and 52 is a wire having a diameter of 0.2 mm to 0.5 mm, but not limited to such. In addition, the conductive members 51 and 52 may have a plate-like shape. These modification examples can also achieve the above-described effects.

(5-2) According to the first embodiment, the high-pressure mercury lamp 2 is consecutively lit under conditions substantially the same as conditions where the high-pressure mercury lamp 2 actually operates, and the potential $V_E$ applied to the conductive members 51 and 52 is −50 V or lower. However, it is not particularly necessary to cause the high-pressure mercury lamp 2 to consecutively emit light under conditions substantially the same as conditions where the high-pressure mercury lamp 2 actually operates.

(5-3) According to the first embodiment, a negative potential, with respect to the potential of the electrodes 7, is applied to the conductive members 51 and 52. However, the above-described effects can be achieved even when a positive potential, with respect to the potential of the electrodes 7, is applied to the conductive members 51 and 52. In this case, it goes without saying that different types of impurities are attracted.

(5-4) According to the first embodiment, the conductive members 51 and 52 are wound around the boundary portions between the light emission part 4 and the sealed parts 5, under the assumption that the high-pressure mercury lamp 2 is lit in the state of being horizontally kept. However, as long as the lengthwise axis of the translucent vessel 6 is positioned at an angle of 45 or more degrees with respect to the vertical direction, the above-described effects can be achieved by winding the conductive members 51 and 52 around the boundary portions between the light emission part 4 and the sealed parts 5. The conductive members 51 and 52 do not need to be wound around the boundary portions between the light emission part 4 and the sealed parts 5. The conductive members 51 and 52 can be appropriately provided where alkali metals need to be attracted, depending on a direction of light emission and a temperature.

Second Embodiment

The following describes a lamp unit for a projector, relating to a second embodiment of the present invention. The lamp unit relating to the second embodiment has the same construction as the lamp unit 1 relating to the first embodiment. However, the high-pressure mercury lamp 2 included in the lamp unit relating to the second embodiment is obtained by using a manufacturing method different from the manufacturing method described in the first embodiment.

The manufacturing method for the high-pressure mercury lamp 2 for use in the lamp unit relating to the second embodiment is different from the manufacturing method described in the first embodiment, only in terms of the electric field application step. This difference is described in the following.

Figure 13:
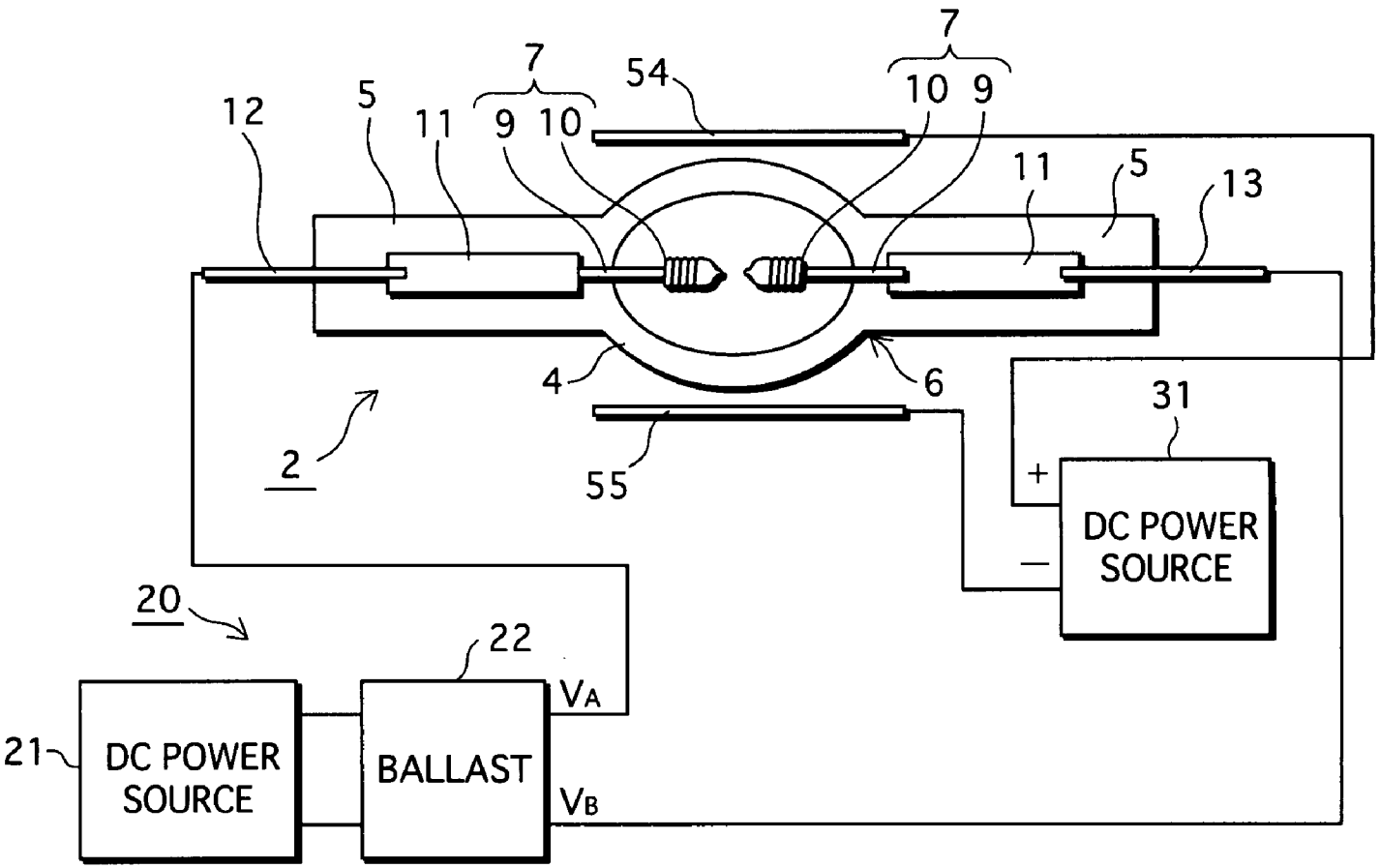
FIG. 13 illustrates an electric field application step in a manufacturing method of an AC-powered high-pressure mercury lamp, relating to a second embodiment of the present invention.

After the lamp formation step is completed, the high-pressure mercury lamp 2 is horizontally kept as shown in FIG. 13. In addition, flat rectangular conductive members 54 and 55, which are made of copper and have a plate-like shape, are arranged so as to sandwich the light emission part 4 vertically. Here, the conductive members 54 and 55 are arranged so that their flat surfaces are substantially parallel to each other and substantially oppose each other.

The distance between the conductive members 54 and 55 can be appropriately determined so that an electric field of a desired strength can be generated, taking into consideration the potential applied to the conductive members 54 and 55. Since devitrification and blackening mainly occur in the light emission part 4, the conductive members 54 and 55 are preferably large enough to be able to cover at least the entire light emission part 4.

The external lead wires 12 and 13 of the high-pressure mercury lamp 2 are connected to the lighting device 20 shown in FIG. 4, and the conductive members 54 and 55 are connected to a DC power source 31.

Here, when the high-pressure mercury lamp 2 is lit in the state of being horizontally kept, for example, the conductive member 55 positioned on the lower side of the lamp 2 is set to be negative, and the conductive member 54 which is positioned on the upper side of the lamp 2 is set to be positive. In this way, alkali metal ions (positive ions), which are the main cause of devitrification, can be attracted to a lower portion of the light emission part 4. Here, the lower portion has a lower temperature than the upper portion. As a result, devitrification of the quartz glass forming the light emission part 4 can be reduced.

The second embodiment achieves the same effects as the first embodiment. In detail, during the manufacturing process of the high-pressure mercury lamp 2, impurities, especially alkali metals, within the space in the light emission part 4 and included in constituents of the lamp 2 (the electrodes 7, the enclosed mercury bromide, the glass members 5*a*, and the like) can be attracted by the applied electric field. The impurities are diffused in the quartz glass, to be dissipated outside the translucent vessel 6. This can reduce devitrification of the quartz glass forming the light emission part 4, and prevent blackening of the internal surface of the light emission part 4, which can take place while the lamp 2 operates. In addition, since at least the light emission part 4 of the translucent vessel 6 is kept at a predetermined temperature or higher, the diffusion speed of the ionized alkali metals in the quartz glass can be increased.

According to the second embodiment, the conductive members 54 and 55 have a rectangular plate-like shape, but not limited to such. As an alternative example, the conductive members 54 and 55 may have a circular plate-like shape, or may be curved so as to run along the external shape of the light emission part 4. In these cases, the above-described effects can be also achieved.

According to the second embodiment, the conductive members 54 and 55 are respectively arranged on the upper and lower sides of the translucent vessel 6. However, the above-described effects can be achieved even when the conductive members 54 and 55 are arranged on the left and right sides of the translucent vessel 6, or in front and at back.

According to the first and second embodiments, the high-pressure mercury lamp 2 is consecutively lit, to heat at least the light emission part 4 of the translucent vessel 6. Thus, at least the light emission part 4 is kept at a predetermined temperature or higher. However, the above-described effects can be achieved even when the high-pressure mercury lamp 2 is repeatedly switched on and off, to keep at least the light emission part 4 of the translucent vessel 6 at a predetermined temperature or higher. As another alternative example, a heating unit, such as a heater, may be used, so as to externally heat and keep at least the light emission part 4 of the translucent vessel 6 at a predetermined temperature or higher.

Furthermore, after the high-pressure mercury lamp 2 is switched on to be lit and then switched off, the heating unit may be used to heat and keep at least the light emission part 4 of the translucent vessel 6 at a predetermined temperature or higher.

According to the first and second embodiments, the high-pressure mercury lamp 2 has a rated power of 220 W, as an example. However, the first and second embodiments can be applied to a high-pressure mercury lamp having a rated power of 150 W, or a rated power of 250 W, which is higher than 220 W.

Third Embodiment

The following describes a lamp unit for a projector, relating to a third embodiment of the present invention. According to the first and second embodiments, impurities such as alkali metals are eliminated from the discharge space or translucent vessel 6 during the manufacturing process of the high-pressure mercury lamp 2. However, the lamp unit relating to the third embodiment is characterized in that impurities are eliminated while a high-pressure mercury lamp actually operates.

(1) Construction of Lamp Unit 201

Figure 14:
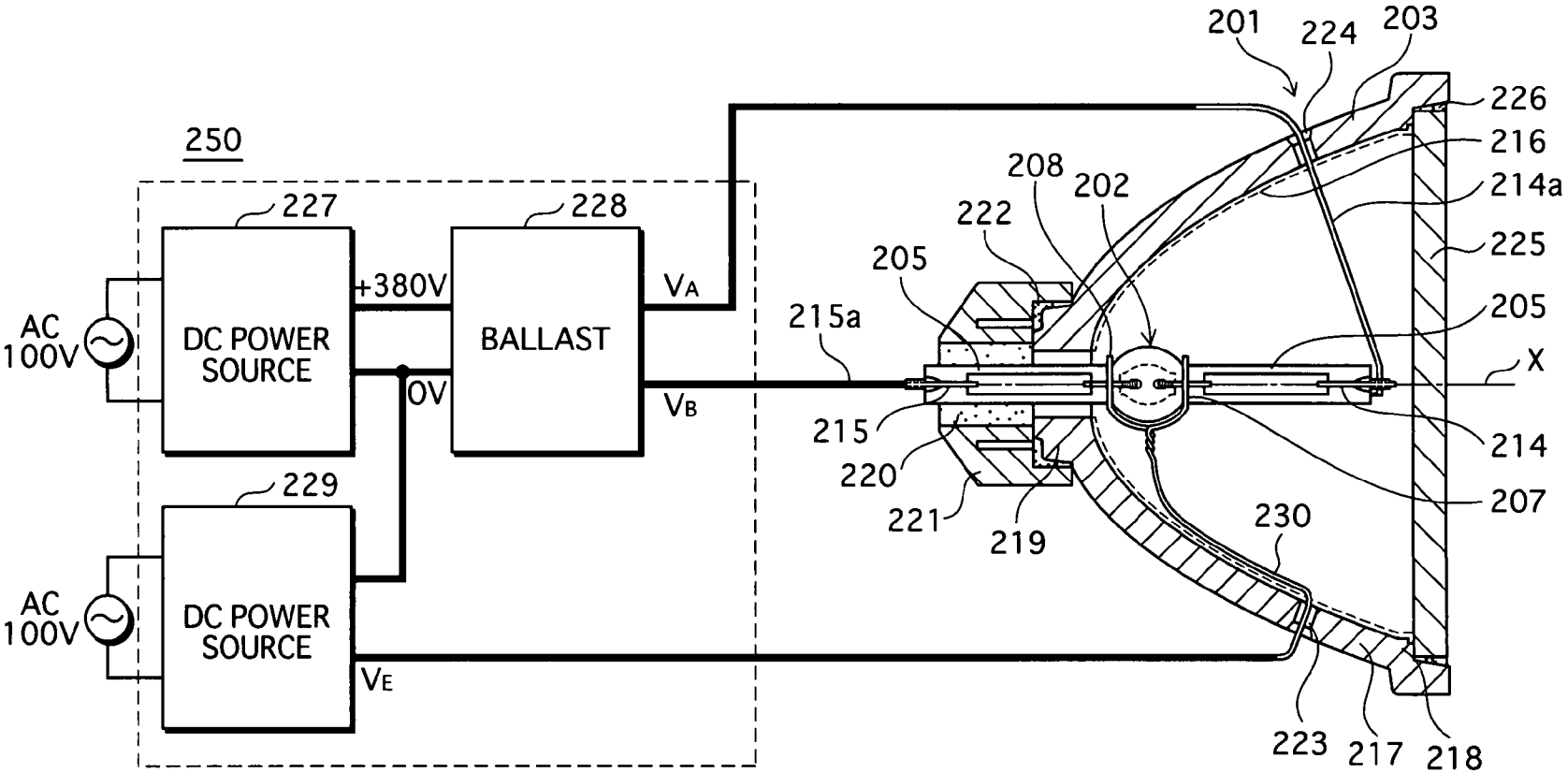
FIG. 14 includes a front cross-sectional view illustrating a lamp unit for a projector relating to a third embodiment of the present invention, and a block diagram of a lighting device relating to the third embodiment.

As shown in FIG. 14, a lamp unit 201 for a projector, relating to the third embodiment of the present invention, is formed by arranging an AC-powered high-pressure mercury lamp 202 having a rated power of 220 W in a concave reflector 203. Here, the high-pressure mercury lamp 202 is positioned in the concave reflector 203 in such a manner that a middle point between paired electrodes 209 (mentioned later) substantially coincides with a focal point of the concave reflector 203 and that a central lengthwise axis X of the high-pressure mercury lamp 202 is substantially parallel to an optical axis of the concave reflector 203 (the axis X coincides with the optical axis in FIG. 14).

Figure 15:
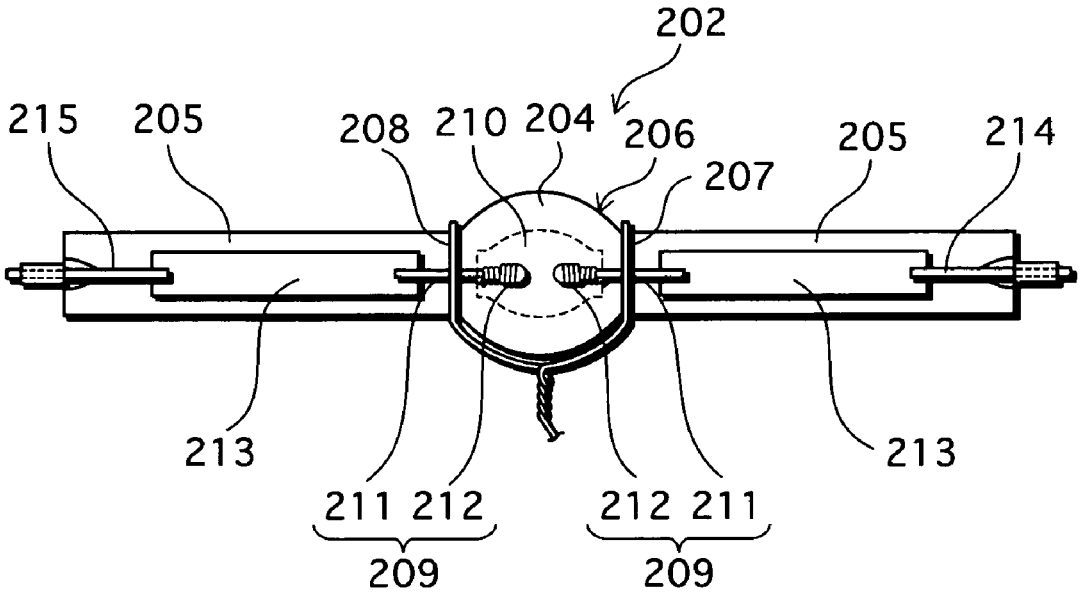
FIG. 15 is a front view illustrating an AC-powered high-pressure mercury lamp shown in FIG. 14.

The high-pressure mercury lamp 202 has a translucent vessel 206 made of quartz glass. The translucent vessel 206 includes a light emission part 204 and sealed parts 205. The light emission part 204 has a substantially spherical or ellipsoidal external shape as shown in FIG. 15, and has a maximum outside diameter of 12 mm, and a maximum thickness of 2.7 mm to 3 mm. The sealed parts 205 have a shape like a cylinder with a diameter of 6 mm, and are formed at the respective ends of the light emission part 204.

While the high-pressure mercury lamp 202 is lit, a load on an inner wall of the light emission part 204 in the translucent vessel 206 is 60 W/cm$^2$ or more, for example, 140 W/cm$^2$. When the translucent vessel 206 is made of quartz glass, the load on the inner wall is preferably 200 W/cm$^2$ or less for actual operation.

The light emission part 204 has an inner volume of 0.2 cc, for example.

Wire-like conductive members 207 and 208 are wound once around boundary portions of the translucent vessel 206 between the light emission part 204 and the sealed parts 205. The conductive members 207 and 208 are in the vicinity of, or in contact with external surfaces of the boundary portions. The conductive members 207 and 208 are made of an alloy of iron, chrome and aluminum, and have a diameter of 0.2 mm to 0.5 mm, for example, 0.2 mm. The conductive members 207 and 208, after being wound around the boundary portions between the light emission part 204 and the sealed parts 205, are positioned so as to run along a lower portion of an external surface of the light emission part 204, when the high-pressure mercury lamp 202 is lit in such a manner that the lengthwise axis (the same as the central axis X) of the translucent vessel 206 is substantially orthogonal to the vertical direction. The conductive members 207 and 208 are provided in the vicinity of, or in contact with the external surface of the lower portion of the light emission part 204. The conductive members 207 and 208 are then twisted together in the middle of the external surface of the lower portion of the light emission part 204, to be connected with each other. One of the conductive members 207 and 208 extends as a lead wire 230.

This construction has the following reason. When the high-pressure mercury lamp 202 is lit in the state of being horizontally kept, an upper portion of an internal surface of the light emission part 204 has the highest temperature. Hence, to avoid positioning the conductive members 207 and 208 in the vicinity of the hottest portion, the conductive members 207 and 208 are connected to each other on the lower side of the light emission part 204, and provided in the vicinity of the internal surface of the portion of the light emission part 204, which has a relatively low temperature.

As seen from FIG. 15, the electrodes 209 are arranged so as to substantially oppose each other in a discharge space 210 within the light emission part 204. In the discharge space 210, mercury (a light emitting substance), a rare gas such as an argon gas and a xenon gas, and a halogen such as bromine is also enclosed.

Here, the amount of the mercury enclosed in the discharge space 210 is 0.15 mg/mm$^3$ or more, preferably 0.35 mg/mm$^3$ or less for actual operation. The amount of the enclosed rare gas is approximately 5 kPa to 40 kPa. The amount of the enclosed halogen is $10^{-7}$ μmol/mm$^3$ to $10^{-2}$ μmol/mm$^3$.

The electrodes 209 are principally made of tungsten. Each electrode 209 includes an electrode rod 211 which has a diameter of 0.3 mm to 0.45 mm and contains impurities of alkali metals and the like, and a coil 212 which is wound around one of the ends of the electrode rod 211 and has the same components as the electrode rod 211. A top end of the electrode 209 is formed as substantially a sphere, by melting the electrode rod 211 and the coil 212 partly. A distance between the electrodes 209 falls within a range of 0.2 mm to 5.0 mm.

The other end of the electrode rod 211 is electrically connected to a corresponding one of external lead wires 214 and 215, through metal foil 213 which is sealed by a corresponding one of the sealed parts 205. The lead wires 214 and 215 and the metal foil 213 are made of molybdenum. The external lead wires 214 and 215 each extend outside the translucent vessel 206.

The following shows, as an example, the impurities included in the electrodes 209, and the amount of the impurities.

| | |
|---|---|
| Potassium | 5 ppm or less |
| Sodium | 5 ppm or less |
| Iron | 5 ppm or less |

Turning back to FIG. 14, the concave reflector 203 includes a body part 217, an opening 218, and a neck part 219. The body part 217 has, in its internal surface, a reflective surface 216 which is a paraboloid of revolution, an ellipsoid of revolution or the like. The opening 218 is formed at one of the ends of the body part 217, and the neck part 219 is formed at the other end of the body part 217.

The high-pressure mercury lamp 202 is adhered to the concave reflector 203, in the following manner. A cap 221, which is fixed to one of the sealed parts 205 using an adhesive agent 220, is connected and fixed to the neck part 219 using an adhesive agent 222.

Out of the external lead wires 214 and 215 of the high-pressure mercury lamp 202, the external lead wire 214 is connected to a power supply line 214*a* that extends outside the concave reflector 3 through a through hole 224 formed in the concave reflector 203. The external lead wire 215 extends outside the concave reflector 203 through the neck part 219, to be connected to a power supply line 215*a*.

A lead wire 230 is connected to the two conductive members 207 and 208 wound around the high-pressure mercury lamp 202. The lead wire 230 extends outside the concave reflector 3 through a through hole 223 formed in the concave reflector 203.

Furthermore, a front glass 225 is adhered to the opening 218 using an adhesive agent 226.

(2) Construction of Lighting Device

The following describes a lighting device to light the high-pressure mercury lamp 202.

As shown in FIG. 14, a lighting device 250 includes a first DC power source 227, a ballast 228, and a second DC power source 229. The first DC power source 227 is connected to an AC power source (AC 100 V). The ballast 228 is connected to the first DC power source 227 and to the power supply lines 214*a* and 215*a*. The second DC power source 229 applies a negative potential, with respect to a potential of the electrodes 209, to the conductive members 207 and 208. The ballast 228 has the same construction as the ballast 22 shown in FIG. 4, and therefore not repeatedly described here.

One of the terminals of the first DC power source 227 is connected to one of the terminals of the second DC power source 229 at the same potential. The other terminal of the second DC power source 229 is connected to the conductive members 207 and 208 that are wound around the high-pressure mercury lamp 202, through the lead wire 230. Thus, a negative potential $V_E$, with respect to the potential of the electrodes 209, is applied to the conductive members 207 and 208 while the high-pressure mercury lamp 202 is lit.

It is assumed that the lighting device 250 is used to light the AC-powered high-pressure mercury lamp 202 having a rated power of 220 W, for example. In this case, the lighting device 250 is configured so that, with respect to a potential of one of the terminals of the first DC power source 227 (0 V), the other terminal of the first DC power source 227 has a potential of 380 V, and the terminal of the second DC power source 229 which is connected to the lead wire 230 has the potential $V_E$ of −50 V or less.

Accordingly, when the high-pressure mercury lamp 202 is lit in a steady state, the potential of the electrodes 209 varies in a range of 0 V to 100 V, and the conductive members 207 and 208 is supplied with the potential $V_E$ of −50 V or less, with respect to the potential of one of the terminals of the first DC power source 227 (0 V).

(3) Verification of Effects

The following describes effects of the lamp unit 201 relating to the third embodiment (hereinafter referred to as the present invented product).

The illuminance maintenance factor (%) of the present invented product is measured after lighting for 1,000 hours, and 2,000 hours, where the illuminance of the present invented product observed after lighting for five hours is assumed to be 100%. A table 4 in FIG. 16 shows results of the measurement.

Here, the potential applied to the conductive members 207 and 208 is −100 V, and the illuminance maintenance factor (%) is calculated based on an average illuminance of a 40-inch screen illuminated by the above-mentioned image display apparatus mounted with the lamp unit 201.

For a comparison purpose, the same measurement is performed for a lamp unit (hereinafter referred to as a compared product) having the same construction as the present invented product, except for that the conductive members 207 and 208 are not provided. The table 4 in FIG. 16 also shows results of the measurement of the compared product.

It should be noted that five present invented products and five compared products are tested.

As clearly seen from the table 4, the present invented product has an illuminance maintenance factor of 74%, even after lit for 2,000 hours, though slight devitrification is found in an upper portion of the internal surface of the translucent vessel 206 (the light emission part 204). However, in all of the tested compared products, the light emission part 204 is swollen and deformed due to devitrification, before 2,000 hours elapses since the start of the lighting.

In the present invented products, blackening is scarcely found on the internal surface of the light emission part 204 by visual observation.

As described above, the lamp unit 201 for a projector, relating to the third embodiment of the present invention, has the following advantages, despite that the used high-pressure mercury lamp 202 has a high rated power of 220 W. In detail, impurities, especially alkali metal ions, within the space in the light emission part 204 are attracted to a portion, which is not the hottest portion, of the internal surface of the light emission part 204, when the high-pressure mercury lamp 202 is lit in a steady state in such a manner that the lengthwise axis of the translucent vessel 206 is substantially orthogonal to the vertical direction. Here, it should be noted that the hottest portion is most likely to devitrify. Instead, the impurities are attracted to the coldest portion of the space in the light emission part 204, which is less likely to devitrify. Specifically speaking, the coldest portion of the space in the light emission part 204 corresponds to a portion of the translucent vessel 206, which is positioned around each of foot portions of the electrodes 209. Thus, the alkali metal ions are less likely to be deposited on the hottest portion of the internal surface of the light emission part 204. This can reduce a progression rate of devitrification in the hottest portion. At the same time, since a halogen cycle is not interrupted by the alkali metals, the internal surface of the light emission part 204 can be prevented from blackening.

There is a slight risk that the alkali metals attracted to around the foot portions of the electrodes 209 chemically reacts with quartz glass provided around the foot portions, to cause the quartz glass to devitrify. However, since the temperature of the quartz glass provided around the foot portions is low, the devitrification is limited, and does not lead to deformation or breakage of the quartz glass. In addition, since the devitrification occurs in the vicinity of each of the foot portions of the electrodes 209, the luminous flux is not reduced.

In conclusion, the lamp unit 201 relating to the third embodiment can produce the following effects. Since the reduction in luminous flux of the high-pressure mercury lamp 202 can be limited, the illuminance maintenance factor can be improved. This can achieve a longer lifetime.

In addition, the image display apparatus using this lamp unit 201 can achieve a higher illuminance maintenance factor on a screen or the like, and a longer lifetime.

In addition to the above measurement, the illuminance maintenance factor (%) of the present invented product is measured after lighting for 1,000 hours, and 2,000 hours, by varying the level of the voltage applied to the conductive members 207 and 208 between 0 V, −25 V, −50 V, −100 V, and −200 V. A table 5 in FIG. 17 shows results of the measurement.

As clearly seen from the table 5, in the case of the applied voltage of −50 V or less, in detail, −50 V, −100 V, and −200 V, the present invented product has the illuminance maintenance factor of 60% or higher, and the translucent vessel 206 is not deformed, even after lighting for 2,000 hours. On the other hand, in the case of the applied voltage of over −50 V, for example, −25 V, the present invented product has the illuminance maintenance factor of 75% after lit for 1,000 hours. Before 2,000 hours elapses, however, the light emission part 204 is swollen due to devitrification, to be deformed.

Considering this result, in the third embodiment, the voltage applied to the conductive members 207 and 208 needs to be −50 V or less, with respect to the potential (0 V) of the electrode of the DC power source 229 which is connected to the DC power source 227, as in the first embodiment. In this way, the translucent vessel 206 is prevented from being deformed at least until 2,000 hours (the rated lifetime) elapses.

Fourth Embodiment

A lamp unit for a projector, relating to a fourth embodiment of the present invention, has the same construction as the lamp unit 201 for a projector, relating to the third embodiment of the present invention, except for the following construction. The lamp unit relating to the fourth embodiment uses, in place of the highly pure electrodes 209, electrodes which are principally made of tungsten and includes impurities of alkali metals, specifically speaking, 10 ppm of potassium and 20 ppm of sodium.

The lamp unit relating to the fourth embodiment uses the high-pressure mercury lamp 202 having a high rated power of 220 W. The electrodes in the high-pressure mercury lamp 202 contain alkali metals of more than 12 ppm, as impurities. The alkali metals evaporate from the electrodes into the discharge space while the lamp 202 is lit, and the evaporated alkali metals increase the risk of devitrification of the quartz glass forming the light emission part 204. However, when the high-pressure mercury lamp 202 is lit in a steady state in the state of being horizontally kept, the alkali metal ions within the space in the light emission part 204 are attracted to a portion, which is not the hottest portion, of the internal surface of the light emission part 204. Specifically speaking, the alkali metal ions are attracted to the coldest portion of the space in the light emission part 204. Here, while the hottest portion is most likely to devitrify, the portion of the translucent vessel 206 which is positioned around the coldest portion is less likely to devitrify. In more detail, the alkali metal ions are attracted to quartz glass forming the portion of the translucent vessel 206, which is in the vicinity of each of the foot portions of the electrodes. In this way, the alkali metal ions are less likely to be deposited on the hottest portion of the internal surface of the light emission part 4. This can lower a progression rate of devitrification in the hottest portion.

There is a slight risk that the quartz glass provided in the vicinity of each of the foot portions chemically reacts with the attracted alkali metals, and therefore devitrifies. However, since the temperature of the quartz glass provided in the vicinity of each of the foot portions is low, the devitrification is limited, and does not lead to deformation or breakage of the quartz glass. In addition, since the devitrification occurs in the vicinity of each of the foot portions of the electrodes, the luminous flux is not reduced.

Fifth Embodiment

Figure 18:
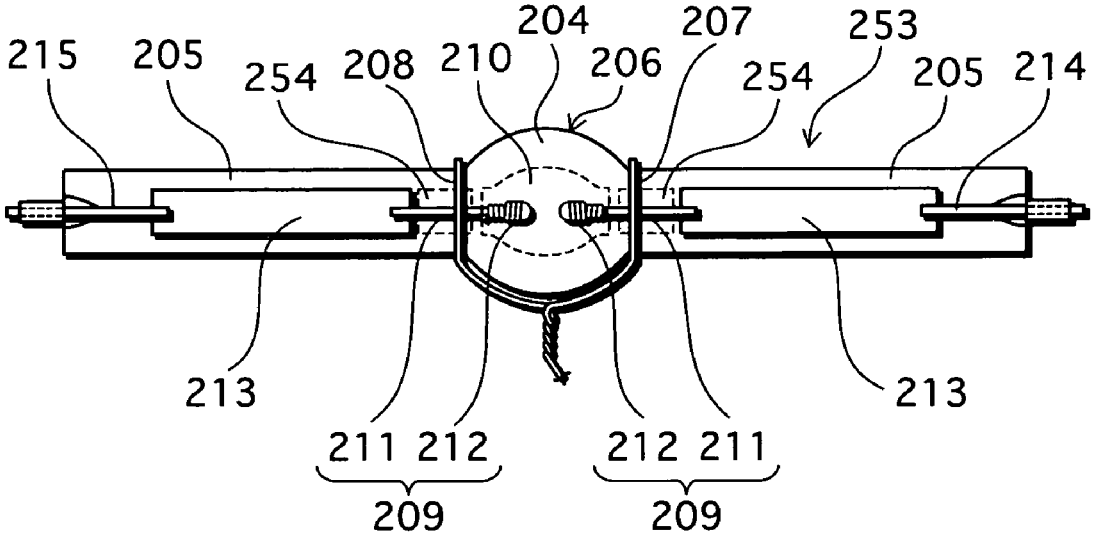
FIG. 18 is a front view illustrating a high-pressure mercury lamp used for a lamp unit for a projector, relating to a fifth embodiment of the present invention.

A lamp unit for a projector, relating to a fifth embodiment of the present invention, has the same construction as the lamp unit 201, relating to the third embodiment, except for the following construction. The lamp unit relating to the fifth embodiment uses a high-pressure mercury lamp 253 having a rated power of 220 W shown in FIG. 18. In the high-pressure mercury lamp 253, tubular glass members 254 made of the above-mentioned VyCor glass are provided between portion of the electrode rods 211 which are placed within the sealed parts 205 and the quartz glass forming the sealed parts 205. The electrode rods 211 are sealed through the glass members 254.

The following shows components of the glass members 254.

$SiO_2$: 96 weight percent or more
$Al_2O_3$: 0.5 weight percent
$B_2O_3$: 3.0 weight percent
$Na_2O$: 0.04 weight percent The lamp unit relating to the fifth embodiment uses the high-pressure mercury lamp 253 having a high rated power of 220 W. In addition, the high-pressure mercury lamp 253 uses the glass members 254 that contain alkali metals as impurities. The alkali metals evaporate from the glass members 254 into the discharge space while the lamp 253 is lit. The evaporated alkali metals increase the risk of devitrification of the quartz glass forming the light emission part 204. However, when the high-pressure mercury lamp 253 is lit in a steady state in such a manner that the lengthwise axis of the translucent vessel 206 is substantially orthogonal to the vertical direction, the alkali metal ions within the space in the light emission part 204 are attracted to a portion, which is not the hottest portion, of the internal surface of the light emission part 204. Specifically speaking, the alkali metal ions are attracted to the coldest portion of the space in the light emission part 204. Here, while the hottest portion is most likely to devitrify, the portion of the translucent vessel 206 which is positioned around the coldest portion is less likely to devitrify. In more detail, the alkali metal ions are attracted to a portion of the translucent vessel 206 in the vicinity of each of the foot portions of the electrodes 209. In this way, the alkali metals are less likely to be deposited on the hottest portion of the internal surface of the light emission part 204. This can slow a progression rate of devitrification in the hottest portion.

There is a slight risk that the alkali metals attracted to the portion of the translucent vessel 206 in the vicinity of each of the foot portions of the electrodes 209 chemically react with the quartz glass in the vicinity of each of the foot portions, to cause the quartz glass to devitrify. However, since the temperature of the quartz glass in the vicinity of each of the foot portions is low, the devitrification is limited, and does not lead to deformation or breakage of the quartz glass. In addition, since the devitrification occurs around the foot portions of the electrodes 209, the luminous flux is not reduced.

According to the third to fifth embodiments, the conductive members 207 and 208 are wound only once around the boundary portions between the light emission part 204 and the sealed parts 205. However, the above-described effects can be obtained even when the conductive members 207 and 208 are wound twice or more.

In the above description, the conductive members 207 and 208 are made of an alloy of iron, chrome and aluminum. However, the above-described effects can be achieved even when the conductive members 207 and 208 are made of a highly heat-resistive metal such as tungsten and molybdenum.

In the above description, the wire-like conductive members 207 and 208 have a diameter of 0.2 mm to 0.5 mm. However, the above-described effects can be achieved even when the conductive members 207 and 208 have a different diameter, or have a plate-like shape, for example.

The conductive members 207 and 208 are wound around the boundary portions between the light emission part 204 and the sealed parts 205, under assumption that the high-pressure mercury lamp is normally lit in such a manner that the lengthwise axis of the translucent vessel 206 is substantially orthogonal to the vertical direction. However, as long as the lengthwise axis of the translucent vessel 206 is positioned at an angle of 45 degrees or more, with respect to the vertical direction, the above-described effects can be achieved by winding the conductive members 207 and 208 around the boundary portions between the light emission part 204 and the sealed parts 205. The conductive members 207 and 208 do not have to be wound around the boundary portions between the light emission part 204 and the sealed parts 205, and can be appropriately provided where the alkali metals need to be attracted, depending on a direction of light emission and a temperature.

The third to fifth embodiments are applied to the high-pressure mercury lamps 202 and 253 having a rated power of 220 W, as an example, but can be applied to a high-pressure mercury lamp having a rated power of 150 W, or a rated power of 250 W, which is higher than 220 W. In particular, the third to fifth embodiments are highly useful if applied to high-pressure mercury lamps having a long lifetime of approximately 1,000 hours and a low rated power of approximately 150 W.

Modification Examples

The technical scope of the present invention is not limited to the above embodiments, and includes the following modification examples.

(1) Electric Field Application Step in First to Third Embodiments

The method to apply the voltage is not limited to those disclosed in the first to third embodiments. Any method can be used as long as a difference in potential is generated between the inside and outside of the light emission part.

According to the first embodiment, the conductive members 51 and 52 are wound around the sealed parts 5. However, a plate-like or a stick-like conductive member may be instead placed below the light emission part 4 of the high-pressure mercury lamp 2 which is horizontally kept. In this case, the present invention can be realized by applying a voltage, which is lower than a potential of the electrodes 7, to the conductive member.

When the light emission part is heated to 600° C. to 1,100° C., the applied electric field needs to have a strength of as least 10 kV/m to sufficiently reduce the impurities in the discharge space and the quartz glass forming the light emission part. The higher the strength of the electric field is, the more impurities can be eliminated. However, an electric field having a strength higher than required to eliminate the impurities just increases the cost because a larger power source device is required. Considering this, the upper limit of the strength of the electric field can be approximately 500 kV/m.

(2) When to Perform Electric Field Application Step in First to Third Embodiments If the light emission part 4 is heated by lighting the high-pressure mercury lamp during the electric field application step as described above, the electric field application step is preferably performed while a lighting performance test (initial lighting) is performed. The lighting performance test needs to be always performed before the high-pressure mercury lamp is shipped out. If the electric field application step is performed during the lighting performance test, the time required for the entire manufacturing process can be shortened.

If the light emission part 4 is heated up by a heating unit such as a heater during the electric field application step, the electric field application step is preferably performed before the above-mentioned initial lighting. If the initial lighting is performed before the electric field application step, the impurities in the discharge space causes blackening and devitrification.

Note that the electric field needs to be applied for at least five minutes, preferably for two hours or more. There is no particular upper limitation to the duration of application of the electric field. However, the electric field just needs to be applied for such a duration that is enough to reduce blackening and devitrification. Taking this into account, the upper limitation is specifically determined by the strength of the electric field, the temperature to which the light emission part is heated, and the manufacturing cost.

The initial lighting is not always prohibited from being performed prior to the electric field application step. It has been confirmed that, when the electric field application step is performed on a lamp which has blackened because of impurities, Na can be eliminated. The lamp is then lit for a few hours to a few dozen hours, which removes the blackening.

Furthermore, the above-described effects can be achieved if at least the light emission part is heated. Moreover, the temperature of the light emission part (4 and 204) is desirably raised to such a temperature (600° C.) or higher that most of the impurities in the discharge space are ionized as mentioned above. When the light emission part is made of quartz glass, the upper limit of the temperature of the light emission part is 1,100° C. to avoid recrystallization.

(3) The manufacturing methods relating to the above embodiments are applied to a double-ended high-pressure mercury lamp. However, the manufacturing methods may be applied to a single-ended high-pressure mercury lamp, and to other types of lamps such as xenon lamps and halogen lamps. To sum up, the manufacturing methods relating to the embodiments of the present invention can be applied to a general high-pressure discharge lamp including a sealed part, in which an internal pressure increases when the lamp is lit.

In other words, the manufacturing methods relating to the embodiments of the present invention can be applied to all kinds of discharge lamps in which blackening and devitrification may occur because of impurities, such as hydrogen and alkali metals (potassium, lithium and sodium), in the light emission part.

Conventionally, noticeable devitrification and blackening occur in a light emission part of a high-pressure discharge lamp having a high output of 200 W or more, and a high-pressure discharge lamp including electrodes principally made of tungsten and containing 12 ppm or more of alkali metals. If the present invention is applied to these high-pressure discharge lamps, significant effects can be produced.

(4) The high-pressure discharge lamps relating to the embodiments of the present invention can be applied to general projector-type image display apparatuses such as 1CCD liquid crystal projectors and DLP projectors, in addition to the 3CCD liquid crystal projector illustrated in FIG. 5.

INDUSTRIAL APPLICABILITY

According to a manufacturing method of a high-pressure discharge lamp relating to the present invention, impurities such as hydrogen and alkali metals within a discharge space and glass forming a light emission part can be reduced. Therefore, the manufacturing method is favorable to manufacture a high-pressure discharge lamp which, despite of its high output, has a long lifetime because of less blackening and devitrification.

The invention claimed is:

1. A high-pressure discharge lamp comprising:

a glass light emission part forming an enclosed substantially spherical or ellipsoidal opening having a pair of electrodes aligned on a longitudinal axis of the light emission part, each electrode extends from opposite sides of the light emission part along the longitudinal axis into the enclosed opening with a spaced gap between ends of the electrodes, an operative amount of mercury is contained within the enclosed opening to support a discharge; and glass sealed cylinder like parts, connecting the electrodes to the light emission part and extending away from the light emission part, are in alignment with the longitudinal axis wherein the amount of Na per unit volume associated with the glass light emission part around the enclosed opening is smaller than the amount of Na per unit volume in the glass sealed parts connecting the electrodes on the opposite sides of the glass light emission part.

2. The high-pressure discharge lamp of claim 1 wherein the spaced gap between ends of the electrode is within a range of 0.2 mm to 5.0 mm.

3. The high-pressure discharge lamp of claim 1, wherein an amount of mercury enclosed in the light emission part is in a range of 0.15 $mg/mm^3$ to 0.35 $mg/mm^3$ inclusive.

4. The high-pressure discharge lamp of claim 1 further including a concave reflector, operatively mounted adjacent the high-pressure lamp in such a manner that a middle point between the electrodes substantially coincides with a focal point of the concave reflector.

5. The high-pressure discharge lamp of claim 1 further including a collecting unit collecting light emitted from the lamp, an image formation unit forming an image based on light collected by the collecting unit, and a projecting unit projecting the image formed by the image formation unit.

* * * * *